US005964533A

United States Patent [19]

Ziglar

[11] Patent Number: 5,964,533

[45] Date of Patent: Oct. 12, 1999

[54] HAMPER APPARATUS AND METHODS

[75] Inventor: Paul S. Ziglar, Burlington, Iowa

[73] Assignee: LaMont Limited, Burlington, Iowa

[21] Appl. No.: 08/714,556

[22] Filed: Sep. 16, 1996

[51] Int. Cl.[6] ..... B65D 33/00

[52] U.S. Cl. ..... 383/36; 383/2; 383/43; 383/104; 383/117; 32/36

[58] Field of Search ..... 383/43, 44, 2, 383/104, 117, 36; 248/97, 99; D32/36, 37; 141/316, 390

[56] References Cited

U.S. PATENT DOCUMENTS

| | | | |
|---|---|---|---|
| Re. 33,842 | 3/1992 | Ebentheuer . | |
| 177,749 | 5/1876 | Redden | 383/36 |
| D. 213,131 | 1/1969 | Hamilton . | |
| D. 215,846 | 11/1969 | Curtin et al. . | |
| 216,227 | 6/1879 | Sedgwick . | |
| 217,362 | 7/1879 | Gardner | 383/36 |
| 218,277 | 8/1879 | Brown, Jr. . | |
| 251,325 | 12/1881 | Walters | 383/43 |
| D. 274,662 | 7/1984 | Fausel . | |
| D. 279,249 | 6/1985 | Fausel . | |
| D. 288,019 | 1/1987 | Gebhard et al. . | |
| D. 290,538 | 6/1987 | Basore . | |
| 481,957 | 9/1892 | Klank . | |
| 665,942 | 6/1900 | Tabler | 383/2 |
| 945,918 | 1/1910 | Crawford . | |
| 1,087,702 | 2/1914 | Patten | 383/104 |
| 1,144,643 | 6/1915 | Elkins . | |
| 1,181,829 | 5/1916 | Bower . | |
| 1,206,618 | 11/1916 | Thrasher | 383/104 |
| 1,263,294 | 4/1918 | Taylor . | |
| 1,360,844 | 11/1920 | Williams | 383/43 |
| 1,394,007 | 10/1921 | Hall . | |
| 1,520,532 | 12/1924 | Clark . | |
| 1,583,083 | 5/1926 | Macaraig | 383/104 |
| 1,640,083 | 8/1927 | Ladd . | |
| 1,647,679 | 11/1927 | Williams . | |
| 1,703,066 | 2/1929 | Horn . | |
| 1,836,297 | 12/1931 | Vienna . | |
| 2,009,035 | 7/1935 | Towers . | |
| 2,042,888 | 6/1936 | Flood . | |
| 2,071,850 | 2/1937 | Miller . | |
| 2,115,308 | 4/1938 | Koch . | |
| 2,280,601 | 4/1942 | Otter | 383/36 |
| 2,295,584 | 9/1942 | Larson . | |
| 2,361,743 | 10/1944 | Butler . | |
| 2,544,074 | 3/1951 | Walter et al. . | |
| 2,600,501 | 6/1952 | Higgs . | |
| 2,625,973 | 1/1953 | Weldon . | |
| 2,639,819 | 5/1953 | Marks . | |
| 2,664,131 | 12/1953 | Miller . | |
| 2,721,099 | 10/1955 | Rupp . | |
| 2,767,757 | 10/1956 | Marder . | |
| 2,780,402 | 2/1957 | Zucker et al. . | |

(List continued on next page.)

FOREIGN PATENT DOCUMENTS

| | | | |
|---|---|---|---|
| 1215335 | 11/1959 | France | 383/36 |
| 281680 | 8/1913 | Germany | 383/2 |
| 5939 | 10/1915 | United Kingdom . | |
| 140570 | 4/1920 | United Kingdom . | |
| 2- 126 535 | 3/1984 | United Kingdom . | |
| 2 212 114 | 7/1989 | United Kingdom . | |

OTHER PUBLICATIONS

Patent Application re: prior art product sold in U.S. by Stephen A. Fausel and Paul S. Zigler: specification for Collapsible Furniture, Jun. 1985.

Eileen Douglas Letter of May 25, 1996.

Eileen Douglas Letter of Aug. 26, 1996.

*Primary Examiner*—J. Casimer Jacyna

*Attorney, Agent, or Firm*—Simmons, Perrine, Albright & Ellwood, PLC

[57] ABSTRACT

A hamper and method for making and using the same: The hamper is for collection, transport, and removal for such contents as laundry. The hamper features can include a funnel or even a reversible funnel for gravity-induced filling and unfilling of the hamper, as well as a retractably collapsible tension member framework structure.

7 Claims, 12 Drawing Sheets

U.S. PATENT DOCUMENTS

| | | | |
|---|---|---|---|
| 2,833,460 | 5/1958 | Vololato | 383/36 |
| 2,958,357 | 11/1960 | Vorgan . | |
| 3,014,516 | 12/1961 | Mueller . | |
| 3,017,117 | 1/1962 | Klingler . | |
| 3,061,396 | 10/1962 | Hock . | |
| 3,126,933 | 3/1964 | Mason et al. . | |
| 3,160,307 | 12/1964 | Morrison . | |
| 3,257,077 | 6/1966 | Corning . | |
| 3,265,284 | 8/1966 | Tomkins . | |
| 3,310,089 | 3/1967 | Silverman . | |
| 3,354,924 | 11/1967 | Birrell . | |
| 3,410,328 | 11/1968 | Sasai . | |
| 3,439,865 | 4/1969 | Port et al. . | |
| 3,480,059 | 11/1969 | Schoening . | |
| 3,583,748 | 6/1971 | Arndt . | |
| 3,603,367 | 9/1971 | Lehrman . | |
| 3,661,326 | 5/1972 | Wilson . | |
| 3,675,981 | 7/1972 | Mallander . | |
| 3,727,786 | 4/1973 | Fausel . | |
| 3,732,978 | 5/1973 | Reader . | |
| 3,796,342 | 3/1974 | Sanders et al. . | |
| 3,799,384 | 3/1974 | Hurkamp . | |
| 3,834,528 | 9/1974 | Pcikford et al. | 206/526 |
| 3,843,222 | 10/1974 | Berkun . | |
| 3,868,155 | 2/1975 | Cherubini . | |
| 3,893,649 | 7/1975 | Cornell . | |
| 3,946,903 | 3/1976 | Parker . | |
| 3,955,706 | 5/1976 | Whitaker . | |
| 4,010,784 | 3/1977 | Nattrass et al. | 383/117 |
| 4,094,639 | 6/1978 | McMillan . | |
| 4,118,089 | 10/1978 | Johnson et al. . | |
| 4,134,225 | 1/1979 | Welch . | |
| 4,180,113 | 12/1979 | Liebling . | |
| 4,195,804 | 4/1980 | Hujsak . | |
| 4,246,945 | 1/1981 | Sterling . | |
| 4,248,278 | 2/1981 | Blodgett | 141/316 |
| 4,248,442 | 2/1981 | Barrett . | |
| 4,287,701 | 9/1981 | Washington . | |
| 4,299,365 | 11/1981 | Battle . | |
| 4,313,634 | 2/1982 | Williams . | |
| 4,352,457 | 10/1982 | Weick . | |
| 4,401,213 | 8/1983 | Lerner . | |
| 4,411,300 | 10/1983 | Rico . | |
| 4,427,110 | 1/1984 | Shaw . | |
| 4,485,855 | 12/1984 | Dillingham | 141/316 |
| 4,580,776 | 4/1986 | Burkinshaw . | |
| 4,585,283 | 4/1986 | Redmon et al. . | |
| 4,603,432 | 7/1986 | Marino | 383/2 |
| 4,610,394 | 9/1986 | Bryson . | |
| 4,630,312 | 12/1986 | Milstein | 383/117 |
| 4,630,747 | 12/1986 | Chiang et al. . | |
| 4,646,802 | 3/1987 | Basore et al. . | |
| 4,683,927 | 8/1987 | Pyzer . | |
| 4,706,845 | 11/1987 | Schnurer . | |
| 4,715,572 | 12/1987 | Robbins . | |
| 4,728,066 | 3/1988 | Lang et al. . | |
| 4,730,748 | 3/1988 | Bane . | |
| 4,738,478 | 4/1988 | Bean, Jr. . | |
| 4,747,701 | 5/1988 | Perkins . | |
| 4,759,518 | 7/1988 | Yardas . | |
| 4,779,794 | 10/1988 | Moore . | |
| 4,781,300 | 11/1988 | Long . | |
| 4,783,031 | 11/1988 | Ebentheuer . | |
| 4,790,029 | 12/1988 | Lafleur et al. | 383/36 |
| 4,854,501 | 8/1989 | Ricci . | |
| 4,858,634 | 8/1989 | McLeese . | |
| 4,899,967 | 2/1990 | Johnson . | |
| 4,903,584 | 2/1990 | Styles . | |
| 4,925,102 | 5/1990 | Jones . | |
| 4,940,200 | 7/1990 | Sawyer et al. . | |
| 4,946,118 | 8/1990 | Hastings . | |
| 4,948,077 | 8/1990 | Gonzalez . | |
| 4,953,815 | 9/1990 | Beymer et al. | 248/97 |
| 4,964,859 | 10/1990 | Feldman . | |
| 4,989,749 | 2/1991 | Choi . | |
| 5,022,767 | 6/1991 | Cardulla . | |
| 5,027,748 | 7/1991 | Wolak . | |
| 5,031,793 | 7/1991 | Chen . | |
| 5,036,999 | 8/1991 | Bitsch . | |
| 5,038,812 | 8/1991 | Norman . | |
| 5,082,219 | 1/1992 | Blair . | |
| 5,118,201 | 6/1992 | Cook | 383/12 |
| 5,143,283 | 9/1992 | Lancaster . | |
| 5,174,462 | 12/1992 | Hames . | |
| 5,195,649 | 3/1993 | Wolters . | |
| 5,253,775 | 10/1993 | Gould . | |
| 5,263,672 | 11/1993 | He . | |
| 5,273,142 | 12/1993 | Weber . | |
| 5,301,705 | 4/1994 | Zheng . | |
| 5,324,490 | 6/1994 | Van Vlahakis . | |
| 5,335,805 | 8/1994 | Chen . | |
| 5,356,024 | 10/1994 | Ho . | |
| 5,358,440 | 10/1994 | Zheng . | |
| 5,375,267 | 12/1994 | Davis . | |
| 5,382,087 | 1/1995 | Pouch . | |
| 5,393,023 | 2/1995 | Callan . | |
| 5,429,437 | 7/1995 | Shaw et al. . | |
| 5,437,384 | 8/1995 | Farrell . | |
| 5,437,410 | 8/1995 | Babasade . | |
| 5,449,083 | 9/1995 | Dougherty . | |
| 5,464,113 | 11/1995 | Ho . | |
| 5,468,061 | 11/1995 | Fries . | |
| 5,474,196 | 12/1995 | Fausel . | |
| 5,492,675 | 2/1996 | Brizard . | |
| 5,576,621 | 11/1996 | Clements | 324/239 |
| 5,593,046 | 1/1997 | Katsuura et al. . | |
| 5,746,514 | 5/1998 | Orensten | 383/117 |

HAMPER APPARATUS AND METHODS

I. BACKGROUND OF THE INVENTION

A. Technical Field of the Invention

The present invention relates to a receptacle apparatus, and method for making and using the same. The receptacle is a hamper for collection, transport, and removal of goods or other articles. In particular, the receptacle can be a laundry hamper or other holder or container for laundry. The receptacle can have a flaccid wall, possibly made of a textile. The wall is intended to be united with a retractably collapsible support or tension member framework structure, with a collapsible wall or a flexible wall being other approaches. The collapsible or foldable framework preferably has a knock down or foldable configuration of spring wire or a similar tension member, such as that which would permit lateral collapsibility.

B. Description of the Related Art

It can of course be said that the art of funneling was robust as of the present invention. But the application of a funnel to certain containers may nonetheless be a novel juxtaposition, and it would be premature to say that every invention involving funneling has been made.

For example, people have been locating laundry in and out of laundry hampers for ages, but the Applicant is not aware of any laundry hamper having previously being made with a funnel top to direct the laundry into the hamper. Perhaps this is due to the fact that laundry hampers have been considered bathroom furniture, and a funnel could be deemed an unsightly accoutrement for furniture.

With regard to such containers, again, certain kinds of them have been made rigid, while others have been made collapsible. Examples of rigid containers include wicker laundry hampers and wicker picnic baskets. Consider U.S. patents issued to Stephen A. Fausel (referenced below). On the other hand, a soft, collapsible cooler has been known, along with accordion-style portable water buckets (U.S. Pat. No. 1,454,388), trash containers (U.S. Pat. No. 3,014,516) large-sized containers (U.S. Pat. No. 3,480,059), bottles (U.S. Pat. No. 3,946,903). None of these have inwardly pointing funnel tops.

Instead, such containers have completely open tops, or hinged tops like laundry hampers, neither of which play an active role in directing items into the container-relegating the task to human positioning, conceivably with the aide of a separate funnel or shute. For example, baskets and containers such as those of U.S. Des. Pat. No. 213,131, U.S. Des. Pat. No. 290,538, U.S. Pat. No. 4,646,802, and U.S. Pat. No. 4,989,749 are presumably loaded by hand. Other containers have separate caps, tops, or doors, like U.S. Pat. Nos. 3,946,903 and 4,246,945, and Fausel's U.S. Pat. No. 5,474,196.

Such containers are often heavy and opaque or of a monotonous color, usually as a consequence of the solid materials with which they are constructed, though occasionally, such containers are painted or otherwise covered over. Consider U.S. Pat. No. 5,464,113 and U.S. Pat. No. 5,356,024, both of which are titled "Collapsible Hamper for Storage of Laundry and Other Items," and both of which list Stanley Ho as the inventor. Such containers would not allow sufficient visual access to determine the contents, and apparently a monotonous coloration may be suitable for a bathroom. See also U.S. Des. Pat. No. 362,931, titled "Laundry Hamper," listing Keith E. Brightbill et al. as inventors; U.S. Des. Pat. No. 344,823, titled "Laundry Hamper," listing Mitchell Wilgus et al. as inventors; U.S. Des. Pat. No. 342,365, titled "Clothes Hamper," listing Brian J. Conway et al. as inventors; U.S. Des. Pat. No. 293,383, titled "Hamper," listing Rick L. Thomson as the inventor; U.S. Des. Pat. No. 279,038, titled "Clothes Hamper," listing Rick L. Thomson as the inventor.

Accordingly, the art appears to have overlooked the sources of many problems (as well as the corresponding solution) that have limited this art.

II. SUMMARY OF THE INVENTION

It is an object of the present invention to provide an improved hamper apparatus and methods for making and using the apparatus.

It is another object of the present invention to provide a hamper improved to solve previously unrecognized problems that have limited this technical art.

It is another object of the present invention to provide such a hamper having a funnel top suitable for using gravity to induce filling of the hamper.

It is another object of the present invention to provide such a hamper having a funnel top suitable for using gravity to induce unfilling of the hamper.

It is still another object of the present invention to provide such a hamper that is restorably collapsible.

It is yet another object of the present invention to provide such a hamper that is restorably collapsible under inducement of a tension member frame.

It is yet a further object of the present invention to provide such a hamper that is suitable for discretely disclosing the extent to which it is full, as well as colorful for location in a bedroom.

These and other objects are carried out with a hamper, such as a retractably collapsible laundry container, topped with a flaccid material and oriented in an upright position, with a slit opening in the top. The opening can function as a funnel or chute to gravity induce material into the container. Further, the funnel has a concave or inward-pointing shape, such that items intended for insertion contact the funnel top on a surface external to the hamper. If the funnel is made of a sufficiently flexible material, when the hamper is inverted so that the items weigh on the funnel, the funnel flexibly moves and is convex or outward-pointing; the goods being removed from the hamper by contacting a surface internal to the hamper. Ergo, it is a hamper with a reversible funnel.

As embodied in an apparatus, the hamper has a wall secured to a top comprising a funnel for funnelling laundry into the hamper. Said another way, the hamper can have a top that functions as a funnel, which can direct material in, and preferably out, of the receptacle. The hamper can be of any functionally suitable shape, and the funnel or channel can slit in the top, the slit leaving the top to sag in a generally concave or convex orientation to use gravity for inducing funnelling in and out of the receptacle.

As to of storage of laundry, goods, property, or other items, the invention pertains to a method of funneling such items into a hamper with a funnel top. Preferably, the funnel is made of a flexible material such that when the hamper is in a vertical position, the items can be funnelled into the hamper, and when the hamper is inverted, the items can then be reverse-funneled out again. More particularly, the hamper preferably is a light-weight collapsible hamper secured to a springed pop-up frame. A method for using such a hamper, like a laundry hamper, can include expanding the hamper from a collapsed position, locating the items in the hamper, transporting the items and hamper, removing the items from the hamper, and then deforming the hamper.

More specifically, the funnel can have an exterior side and an interior side, the funnel being positionable so that when the hamper is in an upright orientation the funnel is in a concave position for gravity-directing items on the exterior side of the funnel into the hamper, and when the hamper is in an upside down orientation, the funnel is in a convex position for gravity-directing items on the interior side of the funnel out of the hamper. The hamper wall can be comprised of a deformable material and a tension member frame secured to the wall to induce movement of the hamper from a collapsed position, and to oppose movement of the hamper from an expanded position. Preferably, the hamper is completely self-erecting from the collapsed position to the expanded position. The frame can be secured to the wall by any suitable means to unite them, but pocketing the frame in the material is a convenient approach.

Importantly, the wall material should be capable of discretely indicating the extent to which the hamper is filled. One alternative is for the wall to be comprised of a translucent material for discretely indicating how full the hamper is. Alternatively, or in addition, a deformable wall material can be used for the same purpose. The material preferably has a thickness less than 0.004 inch, and/or woven, say, with at least 50 threads per inch. The material can even be waterproof.

In either of these approaches, it is preferable to color the wall, especially with more than one color, best selected for the intended environment of the hamper. While there may have been a time that such hampers were principally located in a bathroom or laundry room (where minimizing expense and styling led to monotonous coloration), it is believed that such hampers often can better be located in a bedroom—e.g., where a college student keeping a hamper in a dormitory room. Thus, it is sometimes preferable for the hamper wall to be color coordinated for location in a bedroom. It is also desirable to have handles secured adjacent to the top and made of a material softer than the frame, for light weight transport.

The container can generally be in the shape of a geometric solid, such as a cylinder or a polygon, having a top with a funnel. The opening can be a slit in cloth, with or without an overlap or means for closure (e.g., zipper, velcro, or other type of fastener) because when the overlap or closure is opened, the cloth will sag to form a funnel-shaped opening.

The hamper can have a height dimension and a width dimension proportioned such that a ratio of the height dimension to the width dimension is greater than 0.7—or in another embodiment the ratio of the width dimension to the height dimension is greater than 0.7, depending on whether the intended use is for a tall hamper or a short hamper. Consider the following two applications. One calls for a hamper to fit in a narrow, tall space, say, between a radiator and a corner; another calls for a short, squat hamper, e.g., to fit under a bed. In typical applications, the hamper preferably has a height is in the range of 20 to 26 inches and a top has a width in the range of 18 to 20 inches. This realm of structure is suitable for its laundry function, as well as the environment of its use.

More particularly, many hamper shapes and configurations can be used to carry out the conception and spirit of the invention. As a representative example, the hamper can be structured so that the wall is comprised of facets or box shaped. But in contrast, the wall can be curvalinear, as in an upwards pointing spring, covered to form cylindrical, conical, or spherical type of shape. Note that the hamper can have a nonretractably deformable base, for example where the structure is carried out with an upwards pointing helical tension member supporting the wall that extends from the nonretractably deformable base. However, the hamper can also have a retractably deformable base or bottom, for example where the base is a loop that can be twisted into a subloop.

As a more detailed discussion of several preferred hamper structures (which tend to be defined by the flexible tension member), consider two approaches: (1) those that when the hamper is in an expanded position, the flexible tension member includes a helical portion between the bottom and the top; and (2) those that do not include a helical portion between the bottom and the top, such as those having some kind of planar spring). As to the latter approach, in the expanded position, some can be configured so that the flexible tension member does not extend from one (of the bottom and the top) to an other (of the bottom and the top), and back to the one again. For example, it is possible to support a hamper with several C-shaped spring members only spanning from top to bottom (or vice versa). This is in contrast to the alternative of having the flexible tension member extending from one (of the bottom and the top) to an other (of the bottom and the top) and back to the one, e.g., as in a configuration where the spring member is shaped like a rubber band centrally draped over a finger. Or one can use a plurality of flexible members, each of the flexible tension members formed in a respective loop, the loops being oriented such that, in the expanded position, each of the loops is defines a respective facet or plane; and in the retracted position: each of the loops does not define a respective facet or plane. In this latter case, when the laundry hamper is not in the upright position, or the upside down position, a portion of a loop forms a base. For example, incorporated by reference is U.S. Pat. No. 5,411,046 for a "Tent," naming Tak Wan as the inventor, which illustrates how the loops can twist into three subloops.

In sum, then, an embodiment of the present invention is a hamper having at least one wall secured to a top and to a base, the top and the base defining an upright orientation for the hamper and an upside down orientation for the hamper, and the top comprises a funnel having an exterior side and an interior side. The funnel is preferably positionable so that when the hamper is in the upright orientation the funnel is in a concave position for gravity-directing material on the exterior side of the funnel into the hamper, and when the hamper is in an upside down orientation, the funnel is in a convex position for gravity-directing material on the interior side of the funnel out of the hamper.

It is desirable to have the hamper have a tension member frame with sufficient spring to deform in response to the hamper being dropped on home a floor and then to resurrect the hamper to the upright position. Better still, the frame can be comprised of a flexible tension member and flexible or flaccid material secured to the frame to form a laundry hamper having an expanded position and a retracted position, the laundry hamper being optionally repositionable to one of the positions. Thus, in the expanded position, the laundry hamper has a bottom, a wall connected to the bottom, and a top connected to the wall, the top having an opening. Laundry hamper has a volume defined by the top, the bottom, and the wall, and the top and the bottom define an upright orientation and an upside down orientation. The tension member induces movement from the retracted position and opposes movement from the expanded position.

As to using such a hamper in the context of laundry, several interesting features can be considered relevant, including the feature that the hamper is useful in a first series of steps, like collecting the dirty laundry in a bedroom or other first location, transporting the dirty laundry (preferably by using handles attached to the hamper) to a laundromat or other second location, and disgorging the dirty laundry from the hamper so that it can be cleaned; then, the hamper can be used as a tool to aide in a second series of temps, like transporting the laundry sans dirt by relocating the laundry back in the hamper (preferably folded to neatly occupy less space) at the second location, then transporting the hamper and laundry back to the first location, whereupon the hamper is unloaded again.

More precisely, the method can be considered as including the steps of: first adjusting a retractably collapsible hamper from a collapsed position to an expanded position, wherein the hamper is comprised of a tension member to induce the hamper to move from the retracted position, and the step of first adjusting is carried out so that the tension member induces adjustment from the collapsed position; first locating dirty laundry in the hamper at a first location; first transporting the hamper and the dirty laundry to a second location; removing the dirty laundry from the hamper at the second location; cleaning the dirty laundry to produce clean laundry; then second locating the clean laundry in the hamper at the second location; second transporting the hamper to the first location; removing the clean laundry from the hamper at the first location; and second adjusting the collapsible hamper from the expanded position to the retracted position, wherein the tension member opposes movement from the expanded position.

The method can be carried out with a hamper comprised of a wall secured to a top comprising a funnel so that the step of first locating dirty laundry in the hamper is carried out by funnelling laundry into the hamper. Among the variety of funnel designs that could be used to carry out the function of gravity induced loading, preferably the funnel has an exterior side and an interior side, the funnel being positionable so that when the hamper is in an upright orientation the funnel is in a concave position for gravity-directing laundry on the exterior side of the funnel into the hamper, and when the hamper is in an upside down orientation, the funnel is in a convex position for gravity-directing laundry on the interior side of the funnel out of the hamper. With this approach, the step of removing the dirty laundry from the hamper is carried out by: rotating the hamper from the upright position to the upside down position and funneling the laundry out of the hamper. A third handle (two adjacent the top and one adjacent the bottom) can be used in rotating the hamper.

As stated above, the wall material is an important consideration for the present invention, in view of the functions of the hamper and the environments where it will be used. Where the wall is comprised of a material sufficiently translucent to discretely indicate how full the hamper is with the dirty laundry, the step of transporting can be carried out in response to the indicating of how full the hamper is. Similarly, the method can be carried out with the hamper being comprised of a flaccid wall united with a tension member frame (having sufficient spring to deform in response to the hamper being dropped on a home floor and then to resurrect the hamper to the upright position) so that the step of filling includes deforming the wall, to discretely indicate how full the hamper is. One can perform the step of transporting the dirty laundry in response to the deforming, again without unsightly disclosure of the dirty laundry itself.

The wall material vis a vis the frame can be such that the step of first adjusting is carried out by locating the wall into a faceted configuration, or (alternatively) by locating the wall into a curvalinear configuration. Depending on the approach used for collapsing the hamper, the step of first adjusting can be carried out by locating the bottom into an undeformed (e.g., untwisted) configuration.

As indicated above, it is desirable that the method further comprising the steps as follows: prior to the first transporting, first lifting the hamper by handles secured to the hamper, the first lifting being carried out at the first location; and prior to the second transporting, second lifting the hamper by the handles at the second location.

Phrased differently, the method for using a hamper can comprise the steps of: filling a hamper; and then unfilling the hamper, wherein: the steps of filling and unfilling are carried out with hamper being comprised of at least one wall secured to a top and to a base, the top and the base defining an upright orientation for the hamper and an upside down orientation for the hamper; and the filling is carried out with the hamper in the upright orientation, and the unfilling is carried out with the hamper in the upside down orientation, and wherein the top comprises a funnel having an exterior side and an interior side, the funnel being positionable so that when the hamper is in the upright orientation the funnel is in a concave position so that the filling is carried out by gravity induced funneling from the exterior side of the funnel into the hamper, and when the hamper is in the upside down orientation, the funnel is in a convex position for gravity-induced funneling from the interior side of the funnel out of the hamper.

Preferably, the wall is a multi-color wall for color coordinated location in a bedroom; and the method further comprises the step of: locating the hamper in a bedroom; and wherein the step of filling is carried out at a bedroom location. In this application, the steps of filling and unfiiling can be carried out with the hamper having a height in the range of 20 to 26 inches and a top having a width in the range of 16 to 20 inches. The hamper preferably also has a height dimension and a width dimension proportioned such that a ratio of the width dimension to the height dimension is greater than 0.7, and/or with the hamper having a top width in the range of 16 to 20 inches and a height in the range of 20 to 26 inches. The wall can be made sufficiently translucent for discretely indicating how full the hamper is. Thin material is desirable for lightweight transport and deformability. For example, the wall can have a thickness less than 0.004 inch. The wall can be made of a material that is woven and have at least 50 threads per inch, preferably more, and can even be waterproof.

For convenient transport the hamper can have handles adjacent the top, preferably made of a material softer than the frame. Further, the hamper can be comprised of: a fastener for closing the funnel after the filling; and for opening the funnel prior to the unfilling. Having the frame united to the wall by pocketing the frame in the material is a light weight and straightforward feature.

In a more particular embodiment of the method for using a laundry hamper optionally repositionable in an expanded position and a retracted position, the method can comprise the steps of: adjusting the laundry hamper from the retracted position into the expanded position; filling the laundry hamper; and then unfilling the laundry hamper; and then readjusting the laundry hamper from the expanded position to the retracted position. This method can be carried out with the hamper being comprised of a flexible tension member frame and flexible material secured to the frame, such that the laundry hamper: in the expanded position, has a bottom, a wall connected to the bottom, and a top connected to the wall, the top having an opening, laundry hamper having a volume defined by the top, the bottom, and the wall, the top and the bottom defining an upright orientation and an upside down orientation; wherein the tension member induces movement from the retracted position; and wherein the tension member opposes movement from the expanded position.

In such a more particular embodiment, the step of adjusting can be carried out with the flexible tension member including a helical spring portion between the bottom and the top, the spring providing sufficient tension to maintain the hamper in the upright position; and wherein the step of adjusting includes the spring portion inducing the movement from the retracted position. However, as implied above, the method of can alternatively be carried out without the flexible tension member including a helical portion between the bottom and the top. In a species of this approach, the step of adjusting is carried out such that, in the expanded position, the flexible tension member does not extend from one, of the bottom and the top, to an other, of the bottom and the top, and back to the one; but in an alternative species, it does so extend. In the latter case, the laundry hamper can be comprised of at least one other flexible member, each of the flexible tension members formed in a respective loop; and wherein: the step of adjusting is carried out such that in the expanded position each of the loops defines a respective plane; and the step of readjusting is carried out such that, in the retracted position: each of the loops do not define a respective plane and a portion of a loop (a subloop) forms a base.

As to all of the foregoing, the method can be carried out with the top including a funnel having an exterior side and an interior side, the funnel being positionable so that when the hamper is filled in the upright orientation the funnel is in a concave position, and when the hamper is in the upside down orientation, the funnel is in a convex position; and wherein the step of filling is carried out with the hamper in the upright position for gravity induced funneling from the exterior side of the funnel into the hamper; and wherein the step of unfilling is carried out with the hamper in the upside down position for gravity induced funneling from the interior side of the funnel out of the hamper. Additionally, the method can be accomplished so that the step of filling is carried out at a first location with contents resulting in a first weight for the filled hamper; and further comprising the step of: first transporting the hamper and the contents to a second location; and wherein the step of unfilling is carried out at the second location; and further comprising the steps of: refilling the hamper at the second location with essentially the same contents but to produce a second weight less than the first weight; second transporting the hamper and the contents therein to the first location; and second unfilling the hamper at the first location.

The slight difference in the first and second weights is attributable, for example, to the loss of dirt from the laundry. On average, a 25 pound load of dirty laundry can weigh 24 pounds by cleaning, and as a preferred load of laundry for the present invention is 7 pounds (±2 pounds), the weigh loss from cleaning will be about ⅛–¼ pound. Of course variables here include lifestyle (how dirty the laundry is) and what kind of garments are used.

III. BRIEF DESCRIPTION OF THE DRAWINGS

This invention will be better understood from the following detailed description taken in conjunction with the accompanying figures of the drawing, wherein.

FIG. 26*a–f* shows a series of alternative designs.

Figure 27:
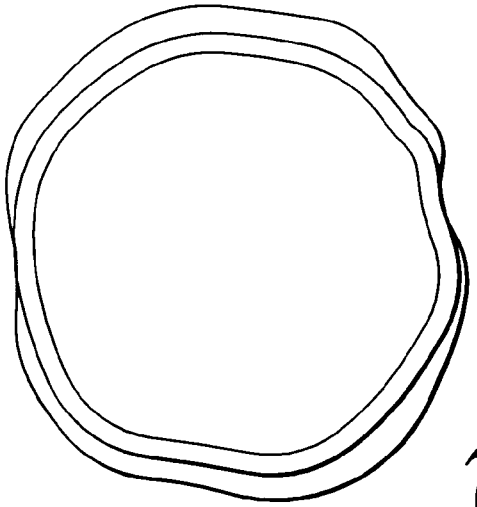

FIG. 27 shows step one in a method for using a hamper in accordance with the present invention.

Figure 28:
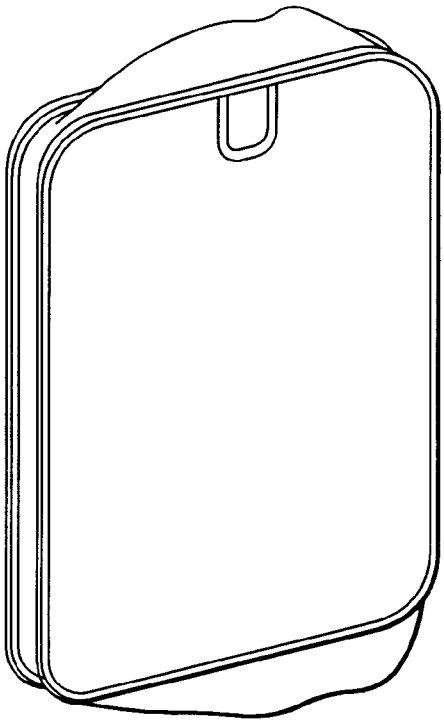

FIG. 28 shows step two in a method for using a hamper in accordance with the present invention.

Figure 29:
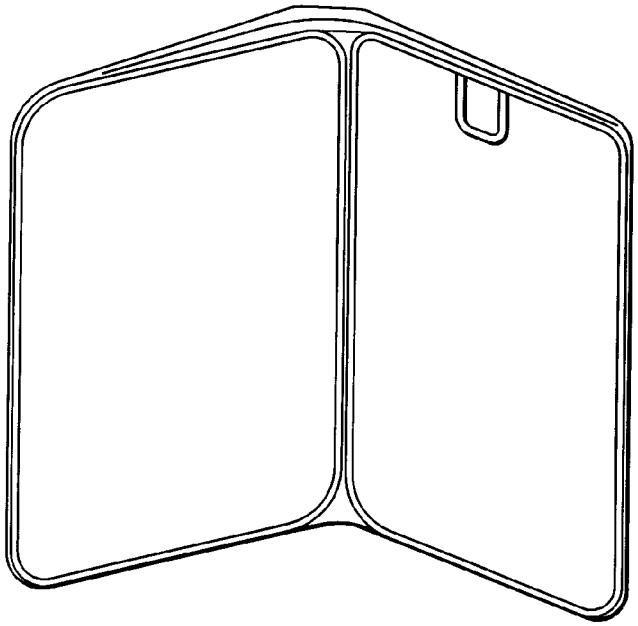

FIG. 29 shows step three in a method for using a hamper in accordance with the present invention.

Figure 30:
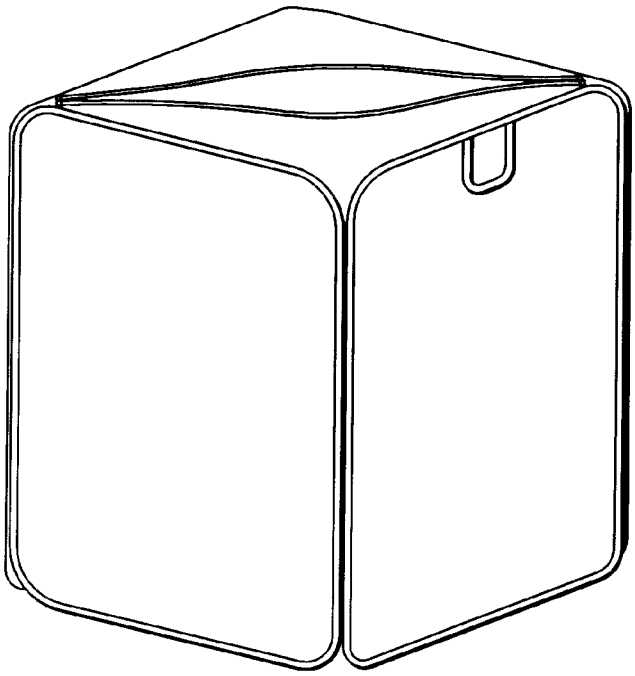

FIG. 30 shows step four in a method for using a hamper in accordance with the present invention.

IV. DETAILED DESCRIPTION OF THE PREFERRED EMBODIMENTS

To make a hamper in accordance with the present invention, many diverse but suitable approaches can be employed. In a broad conception, one can employ container having a wall secured to a top comprising a funnel for funnelling laundry into the hamper. However, several illustrative embodiments provide an opportunity to articulate the invention, in such representatively diverse structural approaches.

A. Representative Rectilinear Hamper

In the following preferred embodiment the hamper (in an expanded position) has a flexible tension member that does not include a helical portion between the bottom and the top of the hamper. For example, a rectilinear approach can be in the shape of a cube, even though many discrete containers with different numbers of facets or sides can be used. The only limitation on the number of sides used for the hamper lies in how thickly the sides of the hamper stack when the hamper is collapsed, as this thickness limits the user's ability to collapse the hamper into the smallest possible package.

A rectilinear approach can have the laundry hamper comprised of at least one other flexible member, each of the flexible tension members formed in a respective loop so that, when adjusted into the expanded position, the loops are oriented to define a respective plane or facet. The following describes the manufacture and use of a hamper in the shape of a cube.

1. Make

In a general embodiment, the hamper is made having at least one wall secured to a top and to a base, the top and the base defining an upright orientation for the hamper and an upside down orientation for the hamper. The top preferably comprises a funnel having an exterior side and an interior side, the funnel being positionable so that when the hamper is in the upright orientation the funnel is in a concave position for gravity-directing material on the exterior side of the funnel into the hamper, and when the hamper is in an upside down orientation, the funnel is in a convex position for gravity-directing material on the interior side of the funnel out of the hamper. In view of household wear and tear, it is useful to have the hamper made with a tension member frame having sufficient spring to deform in response to the hamper being dropped on home a floor and then to resurrect the hamper to the upright position. And if the wall is made of a deformable material, the tension member frame can be secured to the wall to permit retractable collapsing of the hamper from a collapsed position to an expanded position. For light weight convenience, the hamper can have handles adjacent the top and made of a material softer than the frame, and the frame can be secured to the wall by pocketing the frame in the material.

In one configuration alternative to the cube, in the expanded position, the flexible tension member does not extend from one, of the bottom and the top, to an other, of the bottom and the top, and back to the one. In another alternative configuration, in the expanded position, the flexible tension member does extends from one, of the bottom and the top, to an other, of the bottom and the top, and back to the one. For example, where the hamper has a plurality of flexible members, each of the flexible tension members formed in a respective loop, the loops being oriented such that, in the expanded position, each of the loops is defines a respective plane; and in the retracted position: each of the loops does not define a respective plane, the laundry hamper is not in the upright position, the laundry hamper is not in the upside down position, and a portion of a loop forms a base. To further reduce the shelf space that would otherwise be occupied by this configuration, in the retracted position, the loops twist into three subloops.

More particularly, one can make a preferred embodiment as follows.

2. Wall or "Body"

The wall or body of the hamper can be formed of a flexible, flaccid, compressible, deformable, or at least foldable material. For example, a light weight woven or non-woven, natural or artificial material may be used for the wall material. The material can, in a preferred example, have a thickness less than 0.004 inch. Where the material is woven, it can have at least 50 threads per inch. A preferred embodiment uses a body material of 72×96 threads per inch of nylon #1901T taffeta, which is a flaccid material having a thickness of about 0.0035 inch.

One approach is to use a translucent material for discretely indicating how full the hamper is. Another is to use a material that is sufficiently deformable when supported by the frame as to be discretely indicative of how full the hamper is. In either case, it is desirable to use a color, and even better to use multi-color, for the wall material so that the hamper is color coordinated for location in a bedroom.

While the principal contemplated use of the hamper design is for laundry, the hamper can be used for other purposes, e.g., for storage and/or transportation of goods or other items. One can even use the present invention for such storage and transportation of perishables, food, beverage, etc., but then the body material chosen should be waterproof to hold ice and water. Alternatively, the body material can be treated with a waterproofing agent.

The body material should be placed on a conventional cutting table. As necessary, the body material is unfolded or spread out upon the cutting table to allow preparation of several panels and pieces of body material out of which the final body of the hamper will be sewn. Four large, rectangular side panels 7 with rounded corners are cut out of the body material. The rectangular side panels 7 may be of any suitable size with the limitation that they be of equal size to one another. Then one square bottom panel 4, preferably with mitered corners, is cut out of the body material. Two large triangular top pieces 2 with three mitered corners each are next cut out of the body material. Eight small triangular top and bottom corner pieces 3 are then cut out of the body material. Finally, narrow binding strips 1 are cut out of the body material for binding edges of the large triangular top pieces, and wide binding strips 6 are cut out of the body material for binding flat spring wire onto four sides of the hamper. Note that other material can be suitable for the tension member function of the spring wire, such as plastic with a memory (e.g., Lexan). When this operation is complete a total of fifteen major panels and pieces plus numerous assorted strips used for binding have been prepared.

The panels and pieces of body material are then sewn together to form the body of the hamper. All sewing operations can utilize polyester thread 5.

3. Hamper Top

Narrow binding strips 1 are sewn onto each of the long sides of the two large triangular top pieces 2. The two bound edges of the two large triangular top pieces 2 are placed next to one another and four of the small triangular top and bottom corner pieces 3 are sewn onto the four mitered corners formed by the two large triangular top pieces 2. When this sewing is complete, the hamper top appears essentially as a square piece of body material having two sides (what will become an interior side and an exterior side) and with extra long, pointed corners and a diagonal slit running across the middle. Note that additional features can be added to the top, such as a fastener such as velcro strips, optionally, for opening and for closing the top pieces 2. Where the slit is not rigid or very tightly supported, gravity will pull it downward and into a configuration that will operate as a funnel, as discussed in greater detail hereafter.

4. Hamper Bottom

The remaining four small triangular top and bottom corner pieces 3 are sewn onto the square bottom panel 4. Only the shortest leg of each of the small triangular top and bottom corner pieces 3 is sewn to each of the mitered corners on the square bottom panel 4. When this sewing has been completed, the hamper bottom appears as a square with extra long corners and is a retractably deformable bottom.

5. Hamper Sides

To illustrate how to make a wall is comprised of facets, provide each of the four rectangular side panels 7 with wide binding strips 6 attached by sewing to all of its edges. The effect of this sewing is to create an approximately ½" wide enclosure or pocket running around the entire edge of each rectangular side panel 7, into which will be fed flat spring wire 8 at the end of all sewing operations. To accomplish this enclosure effect, the wide binding strips 6 are folded in half as they are sewed onto the edges of the rectangular side panels 7. The sewing of a wide binding strip 6 onto a rectangular side panel 7 commences at a point just off-center of the bottom edge of the rectangular side panel 7, and continues all around the circumference of the rectangular side panel 7. When the entire edge has neared completion, the last 2" of the wide binding strip 6 is left unsewn and unattached, with the last ½" of the wide binding strip 6 being tacked down. An opening is thereby created in the wide binding strip 6 into which the flat spring wire 8 may be inserted at the appropriate time. This sewing operation is to be repeated for each of the other three rectangular side panels 7. If desired, upon two of the rectangular side panels 7 at the center of the top edge a loop 90 of material (which can be woven or non-woven, natural or artificial) can be sewn to the rectangular side panel 7 as the wide binding strip 6 is being attached. These loops 90, secured adjacent the top, can then be used later as handles for the hamper.

6. Joining the Hamper Sides

The long, vertical edges 100 of the rectangular side panels 7 are sewn together to form the hamper's sides. At the end of this stage, the hamper will form a box-like structure with no top or bottom. First, two rectangular side panels 7 are placed next to each other such that the wide binding strips 6 of the panels 7 overlap. The edges of the rectangular side panels 7 are sewn together, with care taken to ensure that the sewing is accomplished on the outside of the stitching used to hold the wide binding strips 6 to the panels 7. In this fashion, the panels 7 are joined together with the wide binding strips 6 forming a channel for insertion of the flat spring wire 8 later in the process. Next, a third rectangular panel is taken and joined to the edge of one of the joined panels 7 in the same fashion that the first two panels 7 were joined. Finally, the final panel 7 is joined to both the third and the first rectangular side panels 7, again using the same procedure.

7. Attaching the Hamper Bottom

At this point the hamper bottom consists of the square bottom panel 4 with four small triangular top and bottom corner pieces 3 attached. The edge of the hamper bottom 4 & 3 is aligned to overlap the wide binding strips 6 and the bottom edges of the rectangular body panels 7 forming the hamper sides. This area of overlapping material is then sewn to create a totally enclosed hamper bottom 4 & 3.

8. Attaching the Hamper Top

The hamper top now consists of the two large triangular top pieces 2 and four small triangular top and bottom corner pieces 3. The edge of the hamper top 2 & 3 Is aligned to overlap the wide binding strips 6 and the top edges of the rectangular body panels 7 forming the hamper sides. The area of overlapping material is then sewn in order to create a totally enclosed space within the hamper, accessible only through the diagonal slit 11 in the hamper top 2 & 3. The slit 11 forms a funnel under the influence of gravity. As suggested above, the two large triangular top pieces 2 have an exterior side and an interior side, with respect to the hamper. The slit 11 or funnel is positionable so that when the hamper is in an upright orientation the funnel is in a concave position for gravity-directing material on the exterior side of the funnel into the hamper, and when the hamper is in an upside down orientation, the funnel is in a convex position for gravity-directing material on the interior side of the funnel out of the hamper.

9. Exterior Finishing

Narrow binding strips 1 are sewn onto all sewn edges on the hamper, including edges on the rectangular body panels 7, the hamper top 2 & 3, and the hamper bottom 4 & 3. After completion of this step, the hamper is turned inside-out to ensure that all "rough" sewing appears only on the inside of the hamper and only finished sewing appears on the outside.

10. Frame

For a tension member frame secured to the wall or body, to induce movement of the hamper from a collapsed position, and to oppose movement of the hamper from an expanded position, wire can be used. The wire used should be of a type sufficiently light-weight to allow the hamper to collapse fully through bending of the wire and be self-supporting when erect, and yet have sufficient strength to uncoil automatically when twisted and bear the weight of the hamper. A flat spring wire 8 can be used. If flat spring wire is used, it can measure 0.032" thick and be 0.125" wide.

The flat spring wire 8, or equivalent tension member, is inserted into the body material of the hamper in the following manner. First, one end of the flat spring wire 8 is pushed into the opening in the wide binding strip 6 of any of the rectangular side panels 7. The wire should be fed through completely around the circuit of the wide binding strip 6 surrounding the rectangular side panel 7, until the free end reappears at the point of original insertion. The flat spring wire 8 can then be cut, taking care to leave sufficient wire to overlap the free end of the wire by about 1½". The two ends of the flat spring wire 8 are thus overlapped, and are crimped together with a metal crimping connector 12. A continuous loop of spring wire is therefore formed surrounding the rectangular side panel 7 of the hamper within the wide binding strip 6. This procedure is repeated four times, once for each of the rectangular side panels 7. Manufacture of the hamper will then be complete. The hamper can then be folded into a collapsed or retracted position for packaging and sale.

11. Final Product

A hamper made in accordance with the above can have a height dimension and a width dimension proportioned such that a ratio of the height dimension to the width dimension is greater than 0.7. The hamper can have a height in the range of 20 to 26 inches and a top having a width in the range of 18 to 20 inches.

B. Use

Use of the hamper made in accordance with the above can include expansion of the hamper, collapsing of the hamper, the placing of goods within the hamper, the removal of goods from within the hamper, and the transportation of the hamper in either its erect or collapsed state. Funneling and reverse funneling are the preferred techniques for certain applications.

1. Erection of the Hamper

Figure 1:
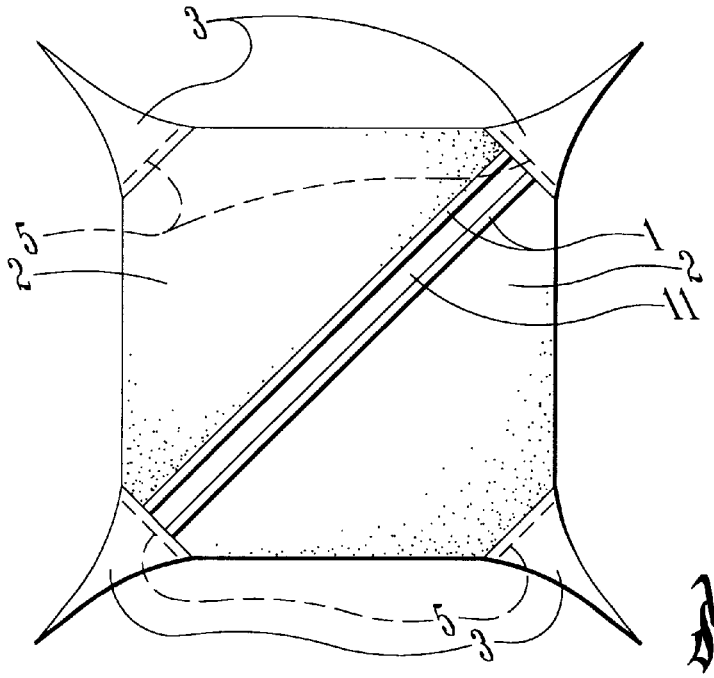
FIG. 1 shows a top view of a rectilinear-shaped hamper's top piece just prior to assembly.
Figure 2:
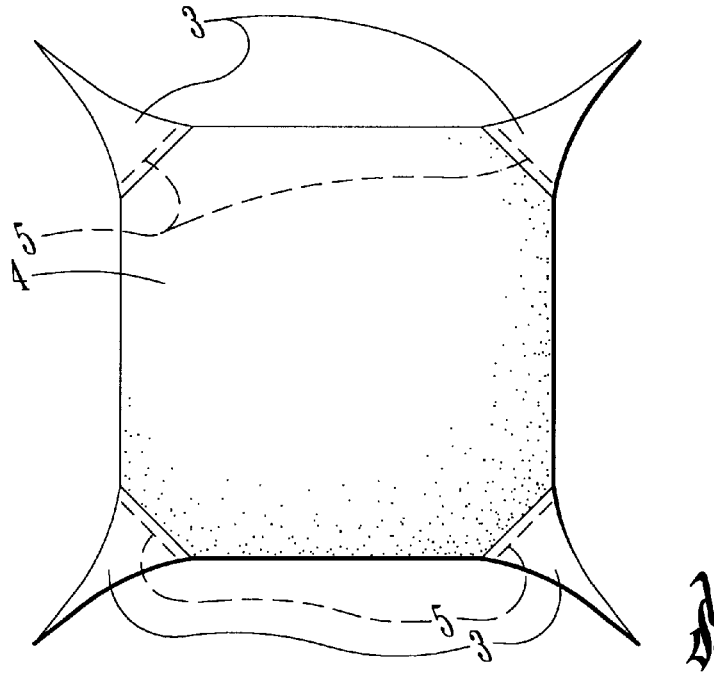
FIG. 2 shows a top view of a rectilinear-shaped hamper's bottom piece just prior to assembly.
Figure 3:
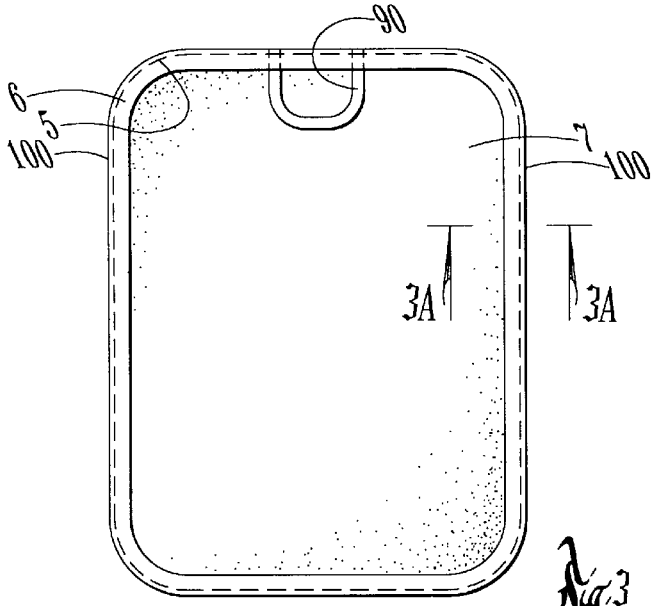
FIG. 3 shows a rectilinear-shaped hamper's rectangular side panel with strap attached.
Figure 3A:
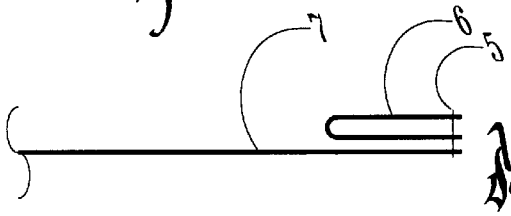
Figure 4:
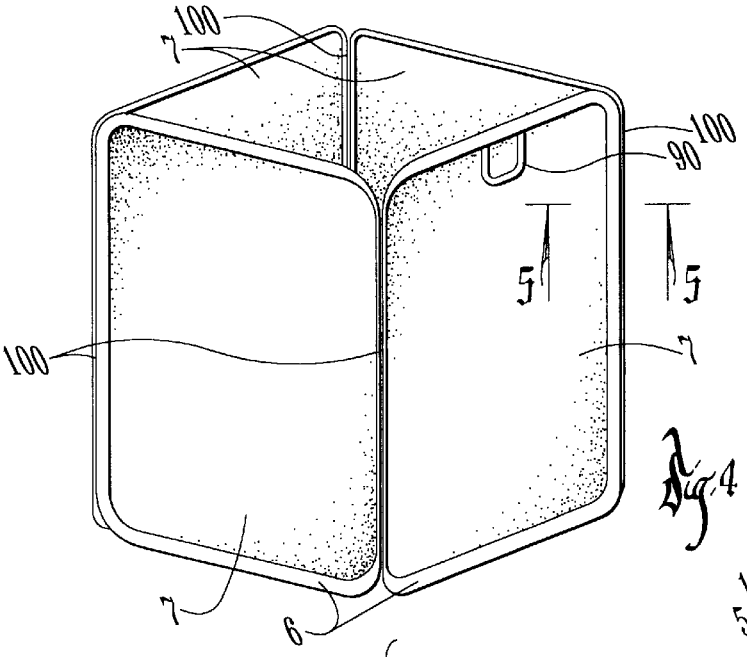
FIG. 4 shows a rectilinear-shaped hamper's rectangular side panels sewn together.
Figure 5:
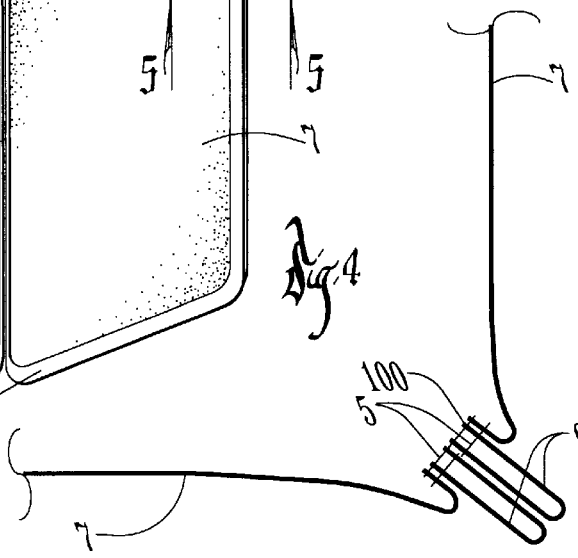
FIG. 5 shows a cross-sectional view of two vertical edge corners of a rectilinear-shaped hamper's rectangular side panels that have been sewn together.
Figure 6:
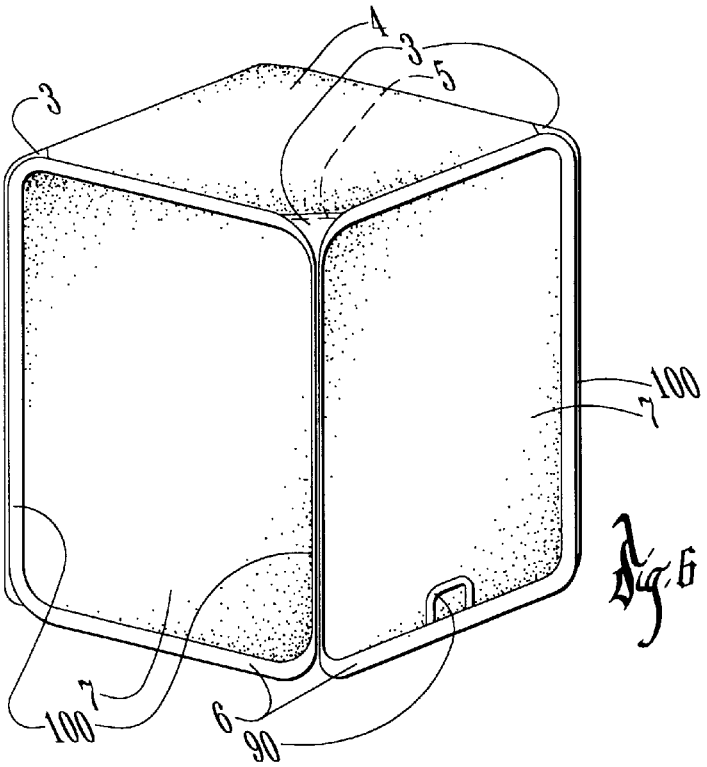
FIG. 6 shows an inverted, perspective view of a rectilinear-shaped hamper partially assembled with rectangular side panels and bottom piece sewn together.
Figure 7:
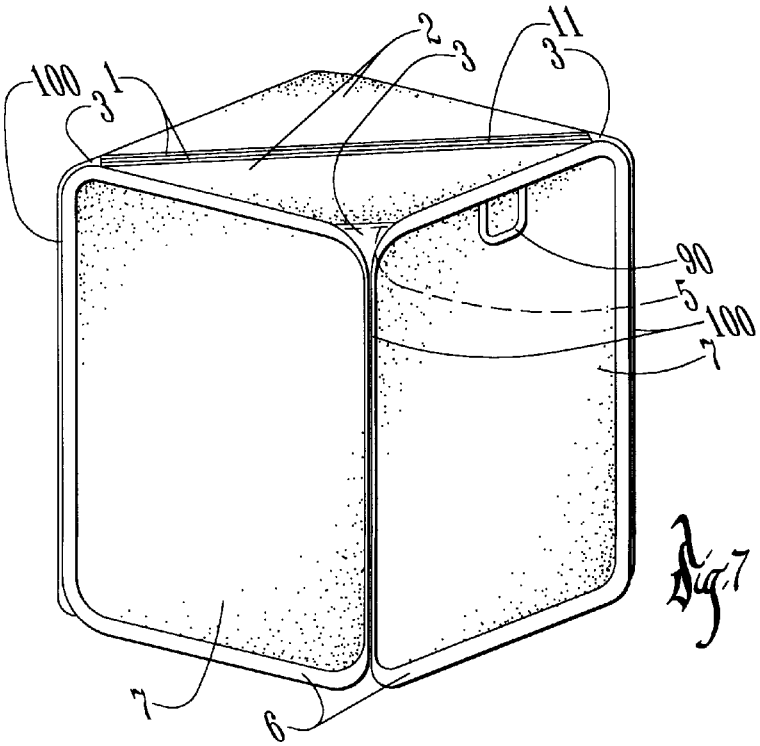
FIG. 7 shows a perspective view of a rectilinear-shaped hamper partially assembled with bottom piece (not shown), rectangular side panels, and top piece sewn together.
Figure 8:
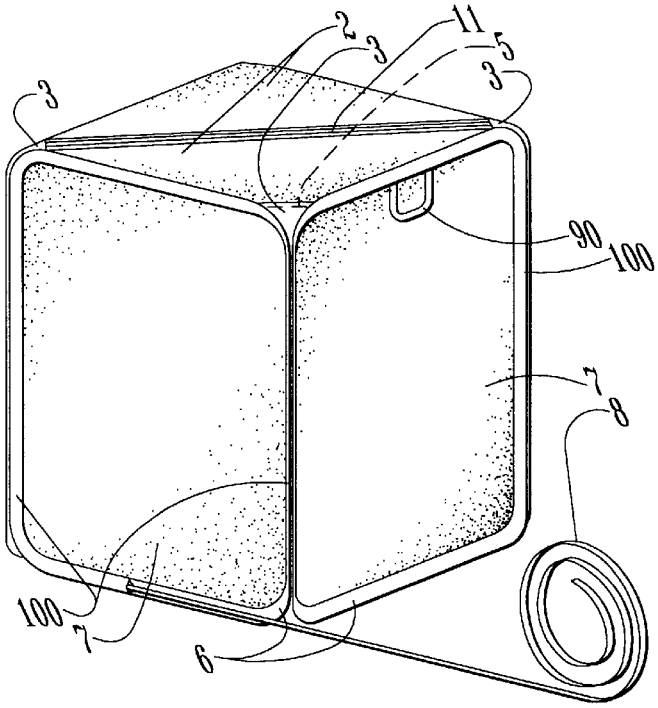
FIG. 8 shows a perspective view of a rectilinear-shaped hamper with spring wire being inserted into the binding of a rectangular side panel.
Figure 9:
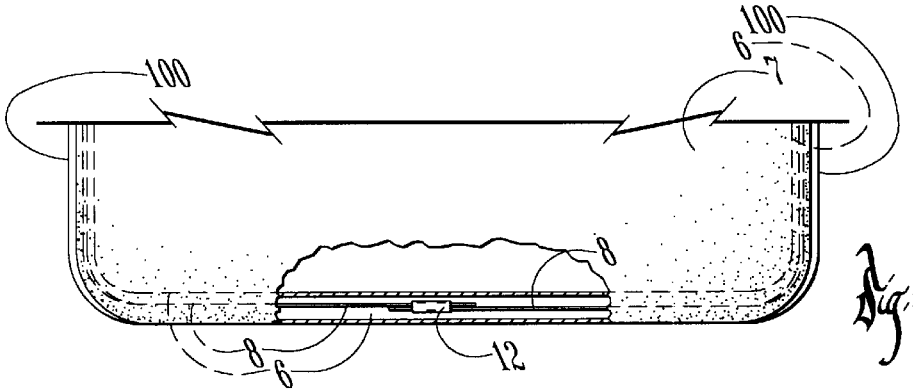
FIG. 9 shows a cut-away view of binding on a rectangular side panel of a rectilinear-shaped hamper with spring wire inside and a crimp connector for the spring wire.
Figure 10:
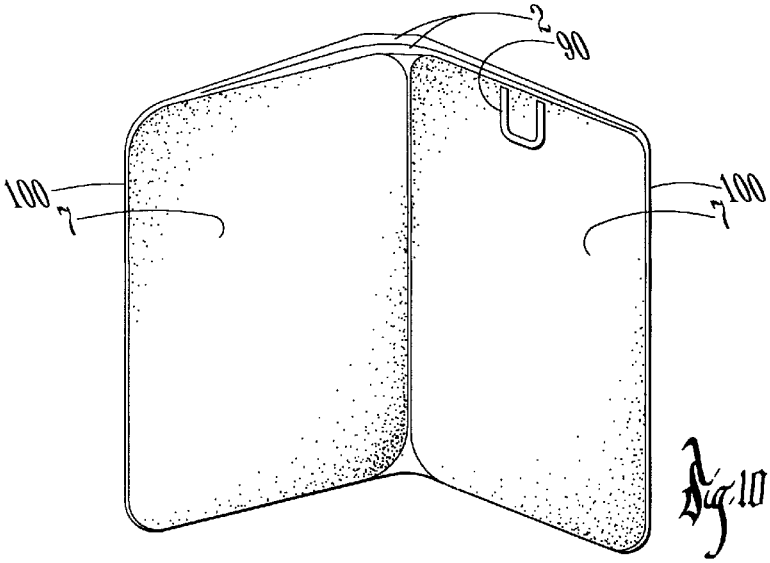
FIG. 10 shows a side view of a fully-assembled, rectilinear-shaped hamper in a state of partial collapse into a "book-shaped" object.
Figure 11:
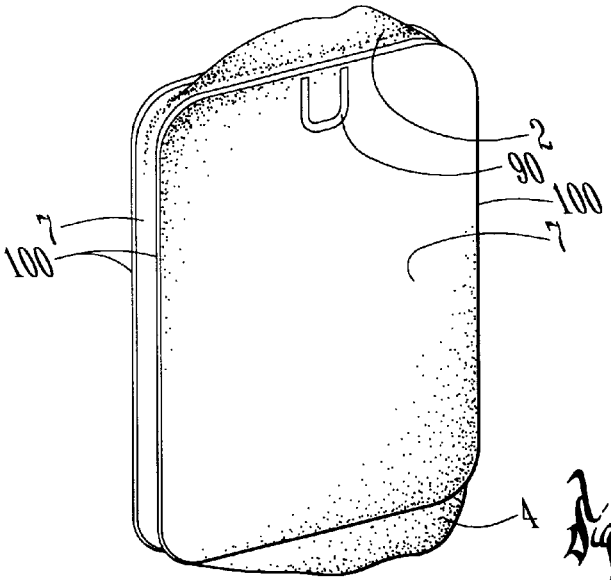
FIG. 11 shows a side view of a fully-assembled, rectilinear-shaped hamper in a more advanced state of partial collapse in which the rectangular side panels have been completely folded to lay on top of one another in a series of successive planes.
Figure 12:
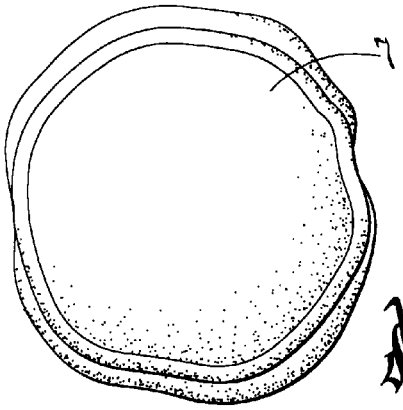
FIG. 12 shows a top view of a fully-assembled, rectilinear-shaped hamper in a fully collapsed position in which it takes on the appearance of three groups of coils.
Figure 13:
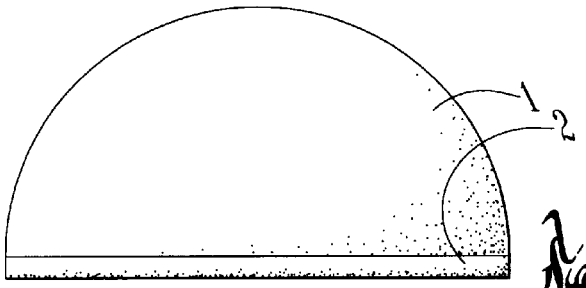
FIG. 13 shows a top view of a half circle of fabric to be used for a portion of a cylindrically-shaped hamper's top panel.
Figure 14:
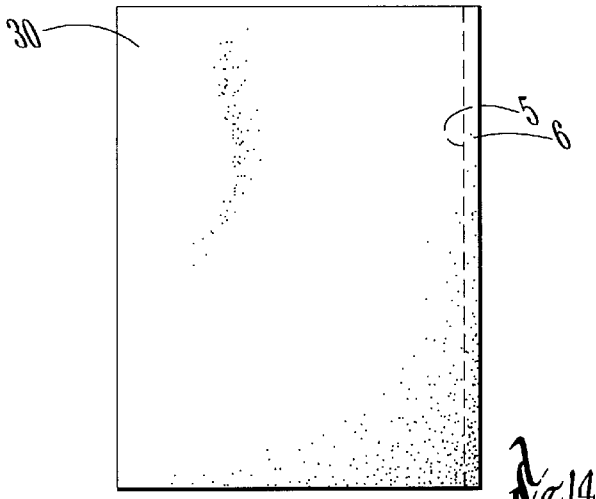
FIG. 14 shows a front view of a rectangular panel used for a cylindrically-shaped hamper's body with its short sides sewn together.
Figure 15:
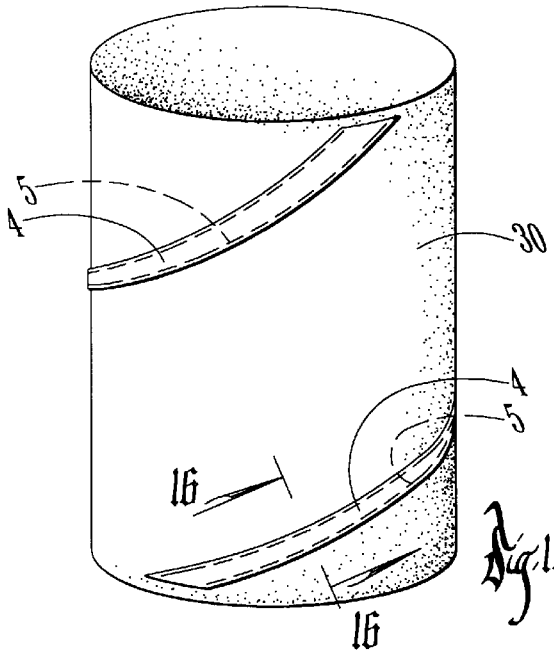
FIG. 15 shows a perspective view of the fabric body of a cylindrically-shaped hamper with helically-shaped wide binding strip attached.
Figure 16:
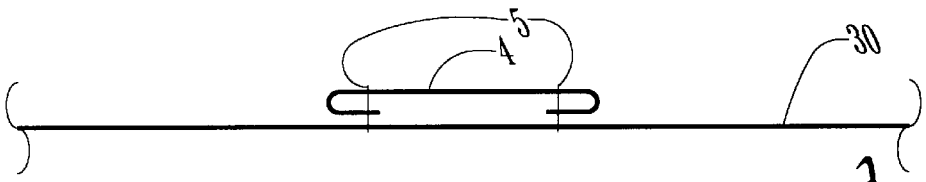
FIG. 16 shows a cross-section of the fabric body of a cylindrically-shaped hamper with helically-shaped wide binding strip attached.
Figure 17:
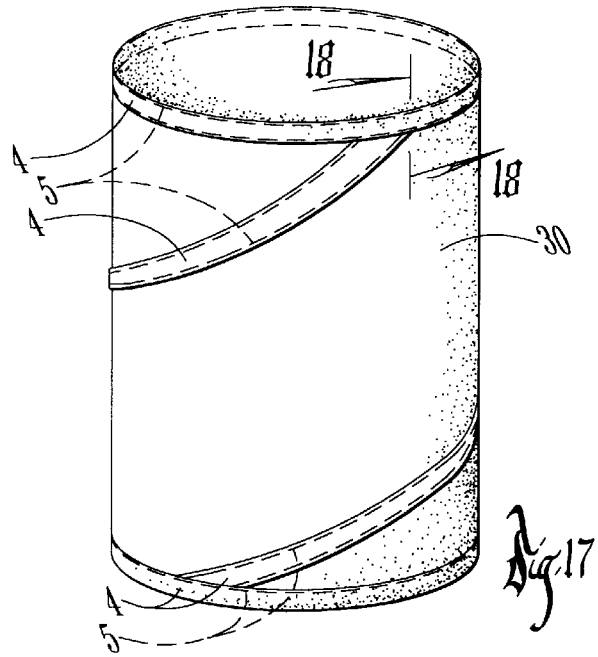
FIG. 17 shows a perspective view of the fabric body of a cylindrically-shaped hamper with all helically-shaped wide binding strip and top and bottom wide binding strips attached.
Figure 18:
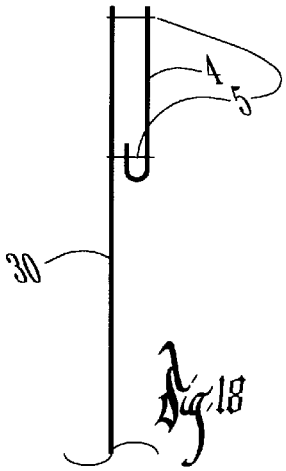
FIG. 18 shows a cross-section of the fabric body of a cylindrically-shaped hamper with top or bottom wide binding strip attached.
Figure 19:
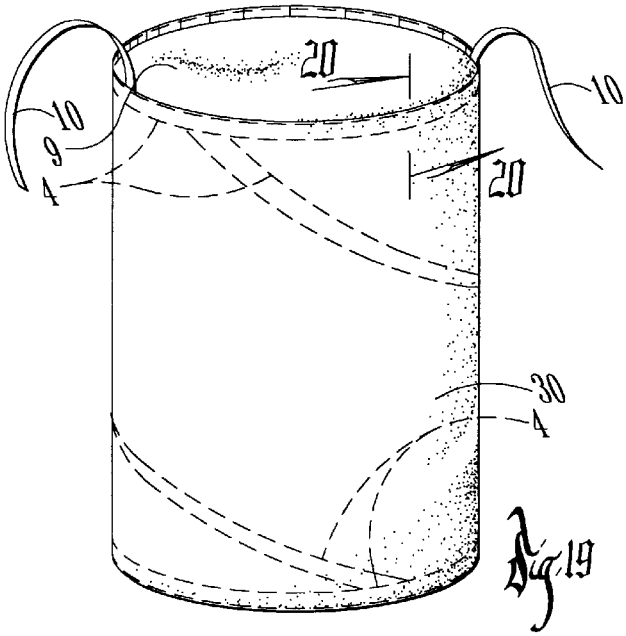
FIG. 19 shows a perspective view of an inverted cylindrically-shaped hamper with bottom panel and tying straps attached.
Figure 20:
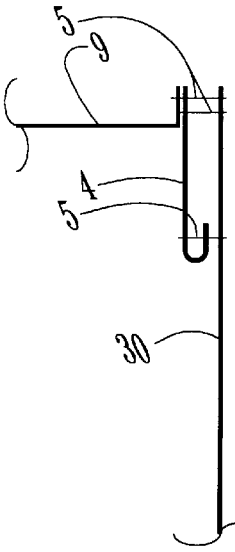
FIG. 20 shows a cross-section of a cylindrically-shaped hamper's bottom panel sewn to the hamper's body.
Figure 21:
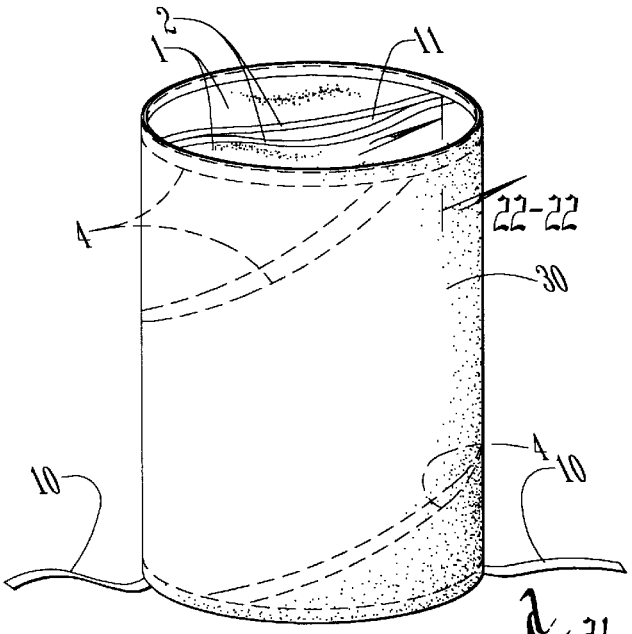
FIG. 21 shows a perspective view of a cylindrically-shaped hamper inside-out with top panel and tying straps attached.
Figure 22:
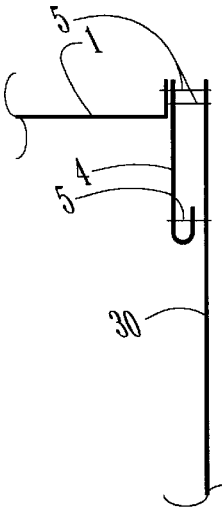
FIG. 22 shows a cross-section of a cylindrically-shaped hamper's top panel sewn to the hamper's body.
Figure 23:
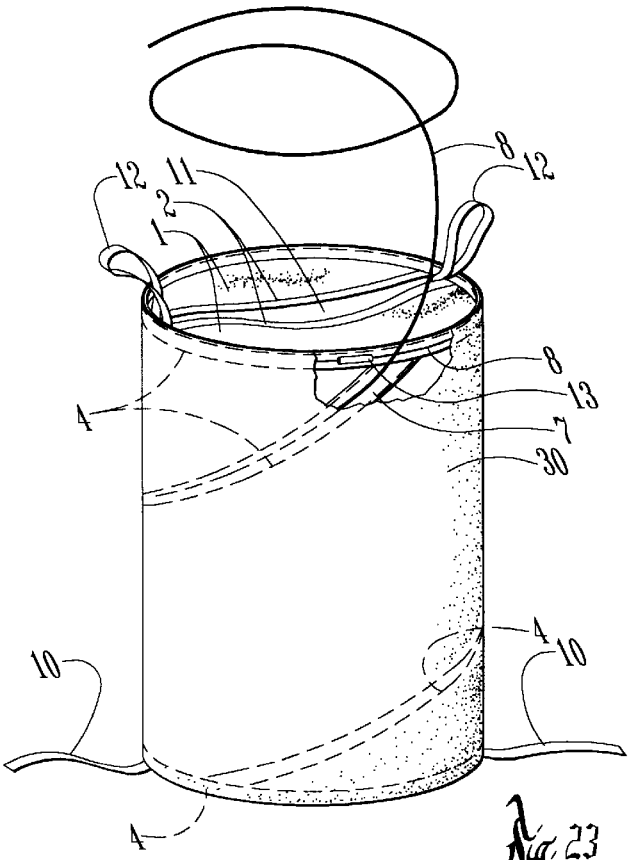
FIG. 23 shows a perspective, cut-away view of a cylindrically-shaped hamper with spring wire being fed into binding and hollow tube in place.

A user receives the retractably collapsible hamper (when new) in its collapsed position, packaged for sale to minimize shelf space, as well as for customer convenience. Upon removing the hamper from the packaging, the user will note that it appears as a stack of three groups of several circular coils of wire within fabric (FIG. 12). The user erects the hamper by first adjusting hamper from a collapsed position to an expanded position, for example beginning by unfolding the hamper. The user grasps the two outside groups of coils and gently pulls them apart with a simultaneous twisting motion. A flat, roughly rectangular shape composed of two main layers is thereby created (FIG. 11). The user now examines the shape to locate an opening between the layers. The user pulls the edges of the layers at the opening gently apart, and the shape opens up like a book (FIG. 10). Complete opening of the now book-like shape is prevented by the presence of two, triangular-shaped pieces of fabric holding the "covers" of the book-like shape together.

As the hamper is comprised of a tension member frame, this step of first adjusting is carried out so that the tension member induces adjustment from the collapsed position. For example, the user reaches into the inside seam of the covers of the book-like shape to the point where the two inside edges of the covers are joined together. The user can then feel two wires within the material of the seam of the shape, one towards the inside surface of the shape and one toward the outside surface. The user gently pulls these two wires apart, exploding the inside seam of the inside surface of the shape outward. When the corners of the shape have been evened by the user pulling them outward, the wall is located into a faceted configuration, and the hamper assumes a full, three-dimensional roughly cubic shape and assembly is complete.

2. Filling the Hamper

The user can fill the hamper, for example, by (first) locating dirty laundry in the hamper at a first location, such as a bedroom. It is preferable for this application for the wall to be color coordinated for location in a bedroom, it can be even better, to have a multi-color wall for this purpose of locating the hamper in a bedroom. Accordingly, the step of filling can be carried out at a bedroom location. Other locations, of course would suffice for filling the hamper.

While the user can place the laundry or other items within the hamper by means of grasping them and passing them through the diagonal slit 11 in the hamper top 2 & 3, there is a better way. By using a the hamper featuring a wall secured to a top comprising a funnel, the step of (first) locating dirty laundry in the hamper can be carried out by funnelling laundry into the hamper. In either case, the items come to rest against the hamper bottom 4 & 3 and/or rectangular side panels 7 and/or other items already within the hamper, and are confined within the hamper.

If the hamper is being used for holding perishable goods such as a member from the group consisting essentially of a food, a beverage, and a combination of food and beverage, and the user wishes the goods to remain cold, then the user may wish to pass or funnel frozen and/or liquid water through the diagonal slit 11 in the hamper top 2 & 3 prior to or after locating the goods within the hamper.

3. Transporting the Hamper and Contents

In the case of laundry, by virtue of the handles and flexible materials, the hamper is convenient for (first) transporting the hamper and the dirty laundry to a second location, such as a laundromat, dry cleaner, or other laundry facility. The notion of transport is premised on an idea of filling the hamper in a different room than where the contents are removed, e.g., where the laundry is cleaned. But the hamper can, of course, be used without transport-accordingly, this step is viewed as a desirable option for certain uses.

If the hamper wall is sufficiently translucent to discretely indicating how full the hamper is with the dirty laundry, the step of transporting is carried out in response to the indicating of how full the hamper is. Alternatively, or in addition, if the hamper wall is a flaccid wall, though united with a tension member frame, the wall can be sufficiently deformable to discretely indicate how full the hamper is with the dirty laundry, such that the step of transporting can be carried out in response to the indicating of how full the hamper is.

Note: Prior to the (first) transporting, first lift the hamper by handles secured to the hamper at the first location.

4. Unfilling the Hamper

Removing the dirty laundry or other contents from the hamper, as mentioned above, is preferably carried out at the second location. Removal by the user of goods from within the hamper consists of completion of the above steps in reverse. In addition, if the goods included foods or beverages that were stored with the assistance of water and/or ice the user may wish to remove the water and/or ice by inverting the hamper and allowing the water and/or ice to pass out through the diagonal slit 11 by force of gravity. In a use pertaining to laundry, after the unfilling step, the dirty laundry is cleaned to produce clean laundry, for example by washing to remove dirt and oil.

Unfilling the hamper is more interesting in the case of the hamper featuring the funnel having an exterior side and an interior side, the funnel being positionable so that when the hamper is in an upright orientation the funnel is in a concave position for gravity-directing laundry on the exterior side of the funnel into the hamper, and when the hamper is in an upside down orientation, the funnel is in a convex position for gravity-directing laundry on the interior side of the funnel out of the hamper. The step of removing the dirty laundry from the hamper can be carried out by rotating the hamper from the upright position to the upside down position, and funneling the laundry out of the hamper.

5. Refilling the Hamper

In some applications of the present invention, it is optionally desirable to refill the hamper at the second location, e.g., the laundry facility. For example, after the clothing has been washed to remove the dirt and oil, the laundry can be folded (as in folding towels and sheets) or bound up (as in joining socks), and then neatly relocated in the hamper. Again, the filling can be carried out by means of the funnelling method. This is particularly advantageous where the clean laundry is balled up socks and the like.

Interestingly, in the laundry application, the hamper is refilled with essentially the same contents as when the hamper was first filled, except that the dirt and oil, etc. has been removed by the washing. Thus, the first filled weight for the hamper and dirty laundry is believed to be slightly greater than the weight of the cleaned laundry (all things considered, particularly humidity). Further, it is interesting that the dirty laundry first funneled into the hamper (and thus uncompressed) seems to occupy more space than folded and/or bundled laundry. Thus, when the hamper is refilled with essentially the same contents as when it was first filled, except that contents have less weight due to the loss of dirt, and are arraigned to occupy less space, if the contents are folded or bundled.

6. Second Transporting of the Hamper

Optionally, the hamper may be transported in either its expanded or collapsed positions, and in its expanded position, the hamper may be transported with items inside or not. For a second transporting the hamper (refilled) back to the first location, this step can represent returning from the laundry facility with the clean laundry in the hamper to the bedroom from whence the method began. If the laundry was for dry cleaning or more particularly for pressing, refilling the hamper would risk wrinkling that which was just pressed. Thus, it is convenient to optionally conduct the second transporting step with the laundry not within the hamper.

If transported when expanded, the hamper may either be grasped and lifted by the straps 9 or may simply be grasped about the body, under the hamper bottom 4 & 3, by the hamper top 2 & 3, or by any combination thereof, and lifted and carried. If transported when collapsed, the entire hamper can simply be grasped by one hand and carried away.

Note again: Prior to the (second) transporting, lift the hamper by the handles at the second location.

7. Second Unfilling of the Hamper

For removing the cleaned laundry from the hamper at the first location, on can manually reach in and withdraw the items, or in the appropriate circumstance, a reverse funneling method can be employed. Recall the embodiment in which the funnel has an exterior side and an interior side, the funnel being positionable so that when the hamper is in an upright orientation the funnel is in a concave position for gravity-directing laundry on the exterior side of the funnel into the hamper, and when the hamper is in an upside down orientation, the funnel is in a convex position for gravity-directing laundry on the interior side of the funnel out of the hamper. In this embodiment, the step of a second removing of the laundry from the hamper is carried out by rotating the hamper from the upright position to the upside down position and funneling the laundry out of the hamper. While this technique is not particularly suitable where it would unfold folded items, it is quite suitable for removing such items as socks.

8. Collapsing the Hamper

The hamper should be empty in order to fully collapse or perform a second adjusting to collapse the hamper from the expanded position to the retracted position. Otherwise, the collapsing will trap contents therein, in the nature of a purse.

The user grasps two diagonally-opposite corners of the hamper and through application of pressure brings them together, repeating this operation (or performing it simultaneously) for the top 2 & 3 and bottom 4 & 3 panels, even though the tension member opposes movement from the expanded position. The hamper now takes on the appearance of the book-shaped structure (FIG. 10) referred to earlier. The user then folds the "covers" of this book-shaped structure in order to create a flat, roughly rectangular shape composed of two main layers (this has the effect of laying all four rectangular side panels 7 of the hamper on top of one another (FIG. 11)). The user then grasps the top edges of the rectangular side panels 7 and the bottom edges, bringing them together by application of compressive pressure while simultaneously twisting them in opposite directions. When the top and bottom edges have been brought together in this fashion, the hamper now presents an appearance of three groups of several coils folded neatly on top of one another (FIG. 12).

B. Representative Curvalinear-walled Hamper

In a second representative configuration, the hamper used is formed with a curvalinear wall, e.g., in the shape of a cylinder. For the sake of brevity, discussion here will focus on curvalinear features-recognizing the inherent features of the invention as separately applied to both a rectilinear embodiment and a curvalinear embodiment, and the manner of their use.

1. Make

Here, as with the above, there generally is a frame comprised of a flexible tension member and flexible material secured to the frame to form a laundry hamper having an expanded position and a retracted position. The laundry hamper is optionally repositionable to one of the positions. The laundry hamper (in the expanded position) has a bottom, a wall connected to the bottom, and a top connected to the wall, the top having an opening. The laundry hamper has a volume defined by the top, the bottom, and the wall, the top and the bottom defining an upright orientation and an upside down orientation. A tension member frame united with the wall induces movement from the retracted position, and the tension member opposes movement from the expanded position.

As above too, the top preferably comprises a funnel having an exterior side and an interior side. The funnel is positionable so that when the hamper is in the upright orientation the funnel is in a concave position for gravity-directing laundry on the exterior side of the funnel into the hamper, and when the hamper is in the upside down orientation, the funnel is in a convex position for gravity-directing laundry on the interior side of the funnel out of the hamper.

Unique in this species of a curvalinear embodiment is that in the expanded position, the flexible tension member can include a helical portion between the bottom and the top.

a. Body

The body of the hamper can be formed of the material discussed above with respect to rectilinear embodiment. The body material is laid upon a conventional cutting table to facilitate the cutting of various pieces from which the hamper's body will formed. One rectangular panel 30 is cut out to form the main body of the hamper. In a preferred embodiment, the rectangular panel 30 cut is 22" wide (the width of the rectangular panel 7 ultimately determines the height of the hamper). Several narrow binding strips 2 are cut out in numbers sufficient for binding the straight edges of the hamper's lid, and for making tying straps 10 for the hamper. Several wide binding strips 4 are cut out in numbers sufficient for binding spring wire in a helical pattern around the bottom, body, and top of the hamper. Once these pieces have been cut out of the body material they may be sewn together as follows using polyester thread 5.

The rectangular panel is used to form the body of the hamper by sewing together its two shorter sides 6, thereby forming a round cylinder with neither a top nor a bottom. If the rectangular panel used is 22" wide, the resulting open cylinder will be 22" high. This cylinder is then turned inside-out, and a wide binding strip 4 is sewn onto the outside of the hamper body in a helical pattern by first being sewn onto the cylinder at its bottom, then making two complete, evenly-spaced ascending revolutions around the cylinder, and then stopping at the top of the cylinder at a point almost directly above the point at which the wide binding strip 4 started at the bottom of the cylinder. Care must be taken to ensure that the wide binding strip 4 is not fully stitched, and instead about 2½" at both ends are left unstitched to facilitate insertion of spring wire 8 later in the process.

Separate wide binding strips 4 are also attached around the circumferences of the top and bottom of the cylinder. The outside surfaces of these wide binding strips 4 should be approximately 1" wide after fastening to the cylinder. First, the rough edges of the wide binding strips 4 are folded under and sewn approximately 1/16" in from the new, finished edge of the wide binding strips 4. The wide binding strips 4 are left unsewn on the ends to create a space within that is approximately 7/8" wide for insertion of spring wire 8 later in the process. The spaces thus created for insertion of spring wire 8 in the wide binding strips 4 located at the circumferences of the top and bottom of the cylinder should be adjacent to the insertion points left open for spring wire 8 in the helical wide binding strip 4.

At this time, the fabric cylinder is turned inside-out again so that the wide binding strips 4 appear on the inside of the cylinder.

b. Hamper Top

Two half circles 1 are cut out of the body material and will serve for the hamper's top panel, with an opening between the two half circles 1 forming the funnel configuration above. Further, a fastener for closing the funnel can be used as described above too. Note that the funnel need not be round, and the mouth can be small, large or very large—the key issue is the funneling function. There should at least be some gravity inducement to aid the filling of the container.

The circular edges of the half circles 1 cut out of the body material are aligned with the top edges of the cylinder and wide binding strips 4 attached thereto. These edges are then sewn together. During this process, at least one and preferably two handles may be attached adjacent to the top to facilitate carrying of the hamper. Another handle can be attached adjacent to the bottom for use in rotating the hamper to disgorge its contents. If handles are to be used, one method is to attach a short polypropylene strap loop 12 at each end of the slit 11 formed by the gap between the straight edges of the half circles 1. When this step has been completed, the only opening into the cylinder will be through the slit 11 in the hamper top.

Narrow binding strips 2 are sewn onto the straight edges of the half circles 1 to provide a cosmetic finish for the edges.

c. Hamper Bottom

A single circle is cut out from the body material to serve as the hamper's bottom panel 9. The edge of the round bottom panel 9 is aligned with the bottom edge of the cylinder and the edge of the wide binding strip 4. The edge of the round bottom panel 9 is then sewn to the edge of the cylinder and the wide binding strip 4 completely around their circumferences. During this process, two 24" tying straps 10 are sewn into the round bottom panel 9 seam opposite one another. 12" of each tying strap 10 is pulled through into the inside of the cylinder before sewing, so that when finally fastened each tying strap 10 has 12" within the cylinder and 12" protruding outside of the cylinder. These tying straps 10 ultimately will allow users to fasten the cylinder hamper in its collapsed position.

d. Frame

A spring wire or more can be used to provide structural support for the hamper. One method is to use round, preformed aluminum spring wire 8 measuring approximately 0.175" in diameter. The spring wire 8 is first inserted into the space or pocket left in the wide binding strip 4 at the top of the cylinder. The spring wire 8 is fed into this wide binding strip 4, completing a circumference of the top of the cylinder. As the free end spring wire 8 comes back around to the point of original insertion, the spring is led out of the wide binding strip 4 in the top of the cylinder and directed into the space left in the helical wide binding strip 4 that wraps around the cylinder. However, before the free end of the spring wire 8 enters the helical wide binding strip 4, a 4" long piece of flexible hose 13 is slipped over it. The flexible hose 13 should have an internal diameter sufficient to allow two pieces of spring wire 8 to pass. In this manner, the flexible hose 13 is used to secure the top free end of the spring wire 8 after it is cut from the spool of spring wire at the end of this pocketing procedure The spring wire 8 is fed throughout the length of the helical wide binding strip 4 until it appears at the opening in the end of the helical wide binding strip 4 at the bottom of the cylinder. A second 4" long piece of flexible hose 13 is now slipped over the other free end of the spring wire 8 protruding from the bottom of the cylinder ultimately to join it to the helical portion, in the above-described manner. After this operation, the free end of the spring wire 8 is fed into the space in the wide binding strip 4 around the bottom of the cylinder. The spring wire 8 is fed throughout the wide binding strip 4, and as the free end comes around to the point of original insertion it is again passed through the flexible hose 13 at the bottom of the cylinder through which it passed earlier. The free end of the spring wire is pushed through further so that it overlaps its earlier length to a distance of about 12". The flexible hose 13 can then slide down both loops of spring wire (the original and the now overlapping) in order to hold the free end of the spring wire 8 tight against the main body of the wire. At the top of the cylinder, the spring wire 8 is cut from the spool, creating a free end of spring wire now also at the top of the cylinder. The flexible hose 13 positioned on the spring wire 8 at the top of the cylinder earlier can now be used to secure the free end of the spring wire just as at the bottom of the cylinder. All of the openings in the helical wide binding strip 4 and top and bottom wide binding strips 4 are then hand-stitched closed.

e. Finishing

The hamper's stitching is cosmetically finished by sewing narrow binding strips 2 to all raw edges on the cylinder, the hamper top, and the hamper bottom 9 where they are joined. After this finishing work, the cylinder is again turned inside out to place all rough sewing on the inside of the hamper and all finished sewing on the outside of the hamper.

The cylinder hamper is complete and can be compressed for packaging and shipment.

2. Use

Generally, the method of use comprises the steps of: filling a hamper; and then unfilling the hamper wherein: the steps of filling and unfilling are carried out with hamper being comprised of at least one wall secured to a top and to a base, the top and the base defining an upright orientation for the hamper and an upside down orientation for the hamper; and the filling is carried out with the hamper in the upright orientation, and the unfilling is carried out with the hamper in the upside down position, and wherein the top comprises a funnel united with the top and having an exterior side and an interior side, the funnel being positionable so that when the hamper is in the upright orientation the funnel is in a concave position so that the filling is carried out by gravity induced funneling from the exterior side of the funnel into the hamper, and when the hamper is in the upside down orientation, the funnel is in a convex position for gravity induced funneling from the interior side of the funnel out of the hamper.

Use of the hamper can also feature expanding the hamper prior to placing contents within the hamper, and later removing the contents. Preferably the filling is carried out at a first location, followed by transporting the hamper and the contents therein to a second location, removing the contents from within the hamper at the second location, restoring essentially the same contents back in the hamper, transporting the hamper and the contents back to the first location, and then re-removing the contents from the container. The container can be stored thereafter in either its erect or collapsed state.

Further, a fastener can be used for closing the funnel after the filling(s) and thereafter opening the funnel prior to the unfilling(s).

a. Erection of the Hamper

A user receives the hamper (when new) in its collapsed position, and must therefore first erect it. This is accomplished quite simply when the user unties the tying straps 10 or otherwise allows the spring to pop up the hamper. The hamper will erect itself as the spring wire decompresses, thereby locating the wall into a curvalinear configuration.

b. Collapsing the Hamper

Where the configuration is helical as above, the base can be deformable or not. A solid base can be used to add weight to help maintain the hamper in an upright position, though for most applications, it is better to use a lightweight and flaccid or deformable bottom. Note that use of a deformable bottom permits relocating the bottom into an undeformed configuration in the manner of the rectilinear configuration that can collapse its base into a subloop. That is, the step of readjusting is carried out such that, in the retracted position: each of the loops do not define a respective plane and a portion of a loop forms a "base."

Figure 24:
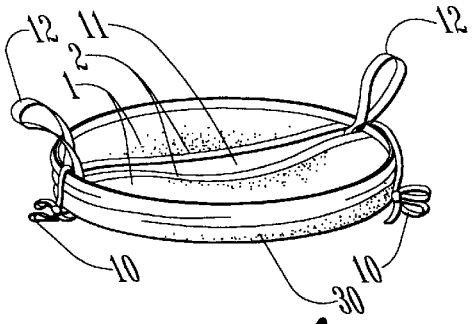
FIG. 24 shows a perspective view of a fully-assembled, cylindrically-shaped hamper in its fully-collapsed position with tying straps secured.
Figure 25:
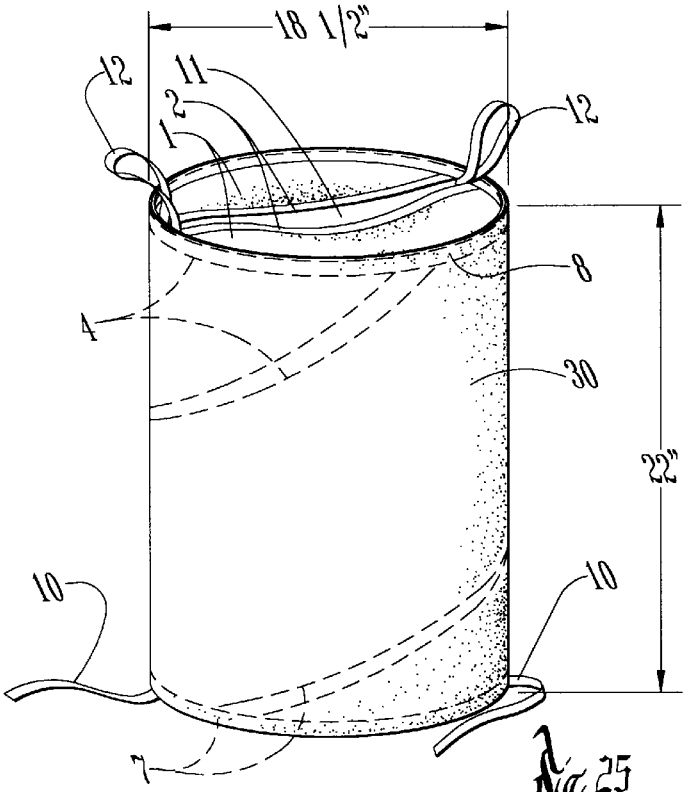
FIG. 25 shows representative dimensions for a curvalinear embodiment of the present invention.

Compare FIG. 24 with 25 for a comparison of the collapsed and the expanded positions of the hamper.

C. Still Other Embodiments

FIG. 26 shows a series of other representative, alternative designs. FIGS. 26*a-b* illustrate that the helical spring portion between the bottom and the top, need not be cylindrical. An outward bulging wall can produce spherical shape in FIG. 26*a*, which contrasts with the inward bulging wall illustrated in FIG. 26*b*. In both of these cases, there is a helical portion between the bottom and the top. A generally cone-shaped is a similarly viable approach (configuration).

Figure 26A:
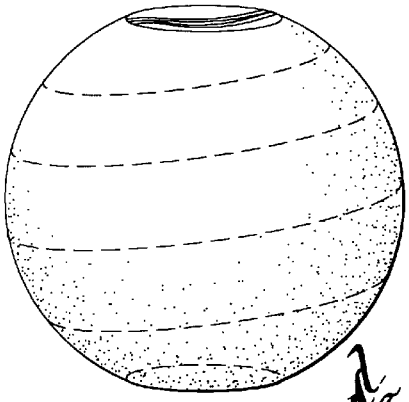
Figure 26B:
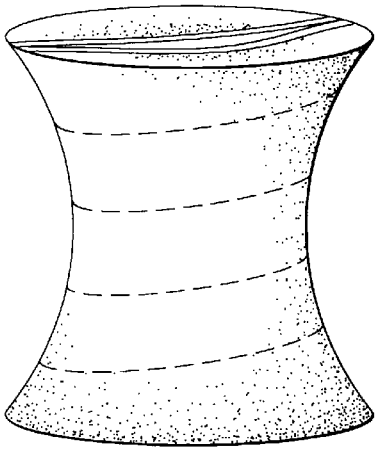
Figure 26C:
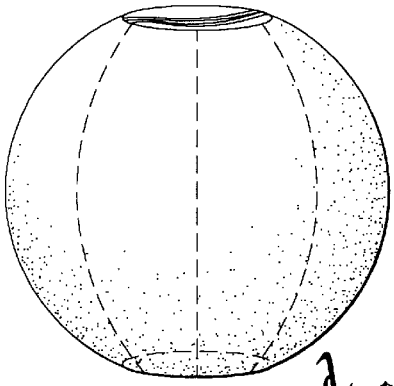
Figure 26D:
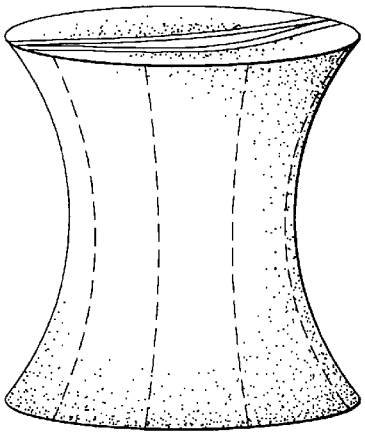

But consider FIGS. 26*c-d*, in which there is a tension member that is not helical. Instead, C-shaped tension members point inward in FIG. 26*c*, and outward in FIG. 26*d*. Note that the C-shaped tension members need not be completely pocketed particularly when outward pointing, or otherwise if the wall is secured along the height of the hamper, such wall can be of a flexible material so as not to interfere with the hamper can be collapsing. In these species of 26*c-d*, the in the expanded position, the flexible tension member does not extend from one, of the bottom and the top, to an other, of the bottom and the top, and back to the one. A variation (not shown) on this theme is to have one member have a loop for the base and then extend upwards to unite with a loop for the top. The loop for the top is part of a member that extends down to unite with the bottom loop. Both members are the tension members, such that in the expanded position, the wall location is defined by the loops and the members.

Figure 26E:
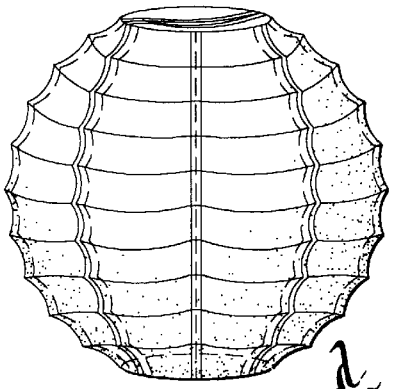

FIG. 26*e* represents a "Chinese Lantern" approach, recognizable by an accordion-like ribbing. In this case, there can be a few reticulated tension members or many little tension members, at least one between each rib.

Figure 26F:
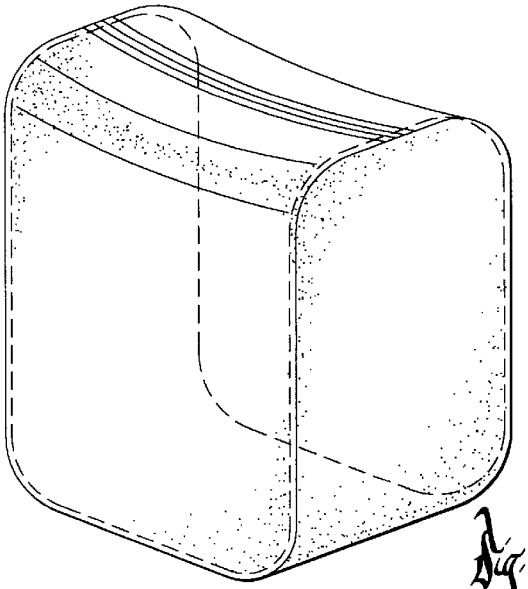

FIG. 26*f* illustrates a design in which a flexible tension member extends from one, of the bottom and the top, to an other, of the bottom and the top, and back to the one.

With regard to such alternative structures, consider the following which like the preceeding referenced patents, are incorporated by reference herein: U.S. Pat. No. 5,467,794, titled "Collapsible Shade Structure," listing Yu Zheng as the inventor; U.S. Pat. No. 5,439,017, titled "Collapsible Frame," listing Douglas M. Brown as the inventor; U.S. Pat. No. 5,360,028, titled "Self-erecting Tent on Folding Base," listing Mark S. Jasin as the inventor; U.S. Pat. No. 5,337,772, titled "Self-folding Shelter," listing Elie E. Habchi as the inventor; U.S. Pat. No. 5,301,705, titled "Collapsible Shade Structure," listing Yu Zheng as the inventor; U.S. Pat. No. 5,137,044, titled "Collapsible Tend Structure," listing David S. Brady as the inventor; and U.S. Pat. No. 5,038,812, titled "Quickly Erectable Quickly Collapsible, Self-supporting Portable Structure," Lowell R. Norman as the inventor; U.S. Pat. No. 4,858,634, titled "Self Erecting Structure," listing Eddie S. McLeese as the inventor; U.S. Pat. No. 3,727,786, titled "Knock Down Hamper," listing Anthony O. Fausel as the inventor; and the patents of Steven A. Fausel: U.S. Des. Pat. No. 274,662, titled "Hamper;" U.S. Pat. No. 5,474,196, titled "Ready-to-assemble Hamper." In any of these cases, as above, the top should be made instead to conform with the dictates of the present invention, including that the top comprises a funnel having an exterior side and an interior side, the funnel being positionable so that when the hamper is in the upright orientation the funnel is in a concave position for gravity-directing laundry on the exterior side of the funnel into the hamper, and when the hamper is in the upside down orientation, the funnel is in a convex position for gravity-directing laundry on the interior side of the funnel out of the hamper.

In view of the above, it is to be understood that various different modifications are possible and are within the true spirit of the invention, the scope of which is to be determined with reference to the claims set forth below. There is no intention, therefore, to limit the invention to the exact disclosure presented herein as a teaching of an embodiment of the invention.

I claim:

1. An apparatus comprising:

a frame comprised of a plurality of flexible tension members each oriented in a loop;

a plurality of walls each coupled to one of said plurality of flexible tension members;

a bottom coupled to each of said plurality of walls so that a container is formed by a combination of said plurality of walls and said bottom; and a top coupled to each of said plurality of walls wherein said top has an opening therein for receiving articles.

2. A hamper comprising:

four translucent flexible panels arranged in a substantially rectangular configuration;

four flexible tension loops;

each of the panels is coupled to and substantially encircled by one of the flexible tension loops;

a rectangularly shaped flexible bottom coupled to each of the panels; and a first flexible handle coupled to one of the panels and a second flexible handle coupled to another of the panels, so that, the handles are on non-adjacent sides of the substantially rectangular configuration of panels.

3. A hamper of claim 2 where each of the four panels is substantially equal in size and shape and the rectangular configuration of panels is a square configuration.

4. A hamper of claim 3 where the flexible tension loop is a wire.

5. A hamper of claim 4 where the wire is a spring wire.

6. A hamper of claim 5 where the spring wire is a flat spring wire.

7. A hamper of claim 3 where the flexible tension loop is a plastic material which exhibits a memory characteristic.

* * * * *